US009217339B2

(12) United States Patent
McConville et al.

(10) Patent No.: US 9,217,339 B2
(45) Date of Patent: Dec. 22, 2015

(54) HYDRAULIC ROLLING CYLINDER DEACTIVATION SYSTEMS AND METHODS

(71) Applicant: Ford Global Technologies, LLC, Dearborn, MI (US)

(72) Inventors: Gregory Patrick McConville, Ann Arbor, MI (US); James Douglas Ervin, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/261,319

(22) Filed: Apr. 24, 2014

(65) Prior Publication Data

US 2015/0308301 A1 Oct. 29, 2015

(51) Int. Cl.
*F01L 1/34* (2006.01)

(52) U.S. Cl.
CPC ..... *F01L 1/34* (2013.01)

(58) Field of Classification Search
CPC ..... F01L 1/34
USPC ..... 123/90.15, 90.16, 90.39, 90.52
See application file for complete search history.

(56) References Cited

U.S. PATENT DOCUMENTS

| | | | | |
|---|---|---|---|---|
| 6,591,795 | B2 | 7/2003 | Janak | |
| 7,827,953 | B2 * | 11/2010 | Roerig et al. | 123/90.48 |
| 8,020,526 | B2 | 9/2011 | Rauch et al. | |
| 2002/0108658 | A1 | 8/2002 | Ootaka et al. | |
| 2004/0003851 | A1 | 1/2004 | Farrar et al. | |
| 2012/0118251 | A1 | 5/2012 | Choi et al. | |

FOREIGN PATENT DOCUMENTS

| | | | |
|---|---|---|---|
| DE | 102006008676 | A1 | 8/2007 |
| DE | 102012221354 | A1 | 1/2013 |
| EP | 1172595 | A2 | 1/2002 |
| JP | 59213914 | A * | 12/1984 |

OTHER PUBLICATIONS

Abstract of JP 59213914 listed above Dec. 1984.*

* cited by examiner

*Primary Examiner* — Zelalem Eshete
(74) *Attorney, Agent, or Firm* — Greg Brown; Alleman Hall McCoy Russell & Tuttle LLP

(57) ABSTRACT

Systems and methods are provided for a poppet valve operator that may be implemented in a hydraulic rolling cylinder deactivation system of a vehicle, wherein a hydraulically operated pivot ball selectively engages a pivot pocket of a rocker arm. Simple and reliable deactivation systems are needed that can fit into limited packaging space while including fewer moving mechanical components that are susceptible to wear and damage. The proposed systems and methods involve selectively pressurizing hydraulic fluid to rigidly or flexibly hold a piston of the poppet valve operator in place in order to open or close a gas exchange valve.

19 Claims, 13 Drawing Sheets

HYDRAULIC ROLLING CYLINDER DEACTIVATION SYSTEMS AND METHODS

FIELD

The present application relates generally to rolling cylinder deactivation systems and methods for selectively opening and closing gas exchange valves of cylinders in an internal combustion engine.

SUMMARY/BACKGROUND

Internal combustion engine systems may operate a series of gas exchange valves in each cylinder of the engine to provide gas flow through the cylinders. One or more intake valves open to allow charge air with or without fuel to enter the cylinder while one or more exhaust valves open to allow combusted matter such as exhaust to exit the cylinder. Intake and exhaust valves are often poppet valves actuated via linear motion provided directly or indirectly by cam lobes attached to a rotating camshaft. The rotating camshaft may be powered by an engine crankshaft. Some engine systems variably operate the intake and exhaust valves to enhance engine performance as engine conditions change. Variable operation of the intake and exhaust valves along with their respective cam lobes and camshafts may be generally referred to as cam actuation systems. Cam actuation systems may involve a variety of schemes such as cam profile switching, variable cam timing, valve deactivation, variable valve timing, and variable valve lift. As such, systems and methods for cam actuation systems may be implemented in engines to achieve more desirable engine performance.

In one approach to provide a cam actuation system, shown by Rauch and Proschko in U.S. Pat. No. 8,020,526, a hydraulic variable valve train is provided to vary the control times and lifting strokes of the gas-exchange valve attached to the variable valve train. This system utilizes a series of hydraulic passages, chambers, accumulators, pistons, and a hydraulic valve to activate the gas-exchange valve. A cam rotates against a pump tappet to pressurize hydraulic fluid in order to actuate a slave piston to move the gas-exchange valve.

However, the inventors herein have recognized potential issues with the approach of U.S. Pat. No. 8,020,526. First, the variable valve train system described in U.S. Pat. No. 8,020,526 may be used primarily for variable valve lift which may require a fast-acting solenoid valve precisely timed to rotation of the engine crankshaft to allow for correct valve event timing. If the solenoid valve were to be mis-timed by a small amount, then the valve events may not be properly timed which may lead to less than desired engine performance. Furthermore, the variable valve train system indirectly conveys motion to the gas-exchange valve by first providing actuation to a pump tappet before transferring the motion to the slave piston. Indirect actuation of the gas-exchange valve via additional components may create higher risk for valve degradation.

Thus in one example, the above issues may be at least partially addressed by a poppet valve operator, comprising: a rocker arm including a poppet valve engaging end and a camshaft engaging end, the rocker arm including a pivot pocket positioned between the camshaft engaging end and the poppet valve engaging end; and a hydraulically operated pivot ball selectively engaging the pivot pocket. In this way, the rocker arm may directly couple to both a cam lobe of a camshaft and a hydraulically operated pivot ball. The pivot ball may further be attached, e.g., directly, to a stem of a piston contained in a housing, wherein the piston may be selectively rigidly or flexibly held in place by hydraulic fluid provided by an external system such as an engine oil pump. With a solenoid valve and accumulator, when valve deactivation is desired, the solenoid valve may be operated at a slower speed than required for the hydraulic valve of U.S. Pat. No. 8,020,526.

In one example, the poppet valve operator may be implemented as a hydraulic rolling cylinder deactivation system, wherein engine displacement is varied by selectively opening and closing a number of intake and exhaust valves, which are often poppet valves. In other examples, the poppet valve operator may be used to actuate variable valve lift or variable valve timing methods. Furthermore, the poppet valve operator may control more than one poppet valve with a single control system comprising of an accumulator and solenoid valve, among other components. Further still, the poppet valve operator may be equipped with a latch pin for reducing leaked oil or other hydraulic fluid when the engine is shut down and pressurized oil is no longer provided to the poppet valve operator. As such, it may be possible to increase available packaging space around the engine by controlling multiple poppet valves with the single control system. Also, including the latch pin may increase the response time of the variable valve lift method upon restarting the engine since the amount of leaked oil may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

While FIGS. 2-3, and 5-12 are not drawn exactly to scale, the drawings may represent example relative positioning of various components with respect to each other, such as axially above or below each other, etc.

DETAILED DESCRIPTION

The following detailed description provides information regarding a multiple of hydraulic rolling cylinder deactivation systems and the operations methods thereof. An example of a cylinder in an internal combustion engine is given in FIG.

Figure 1:
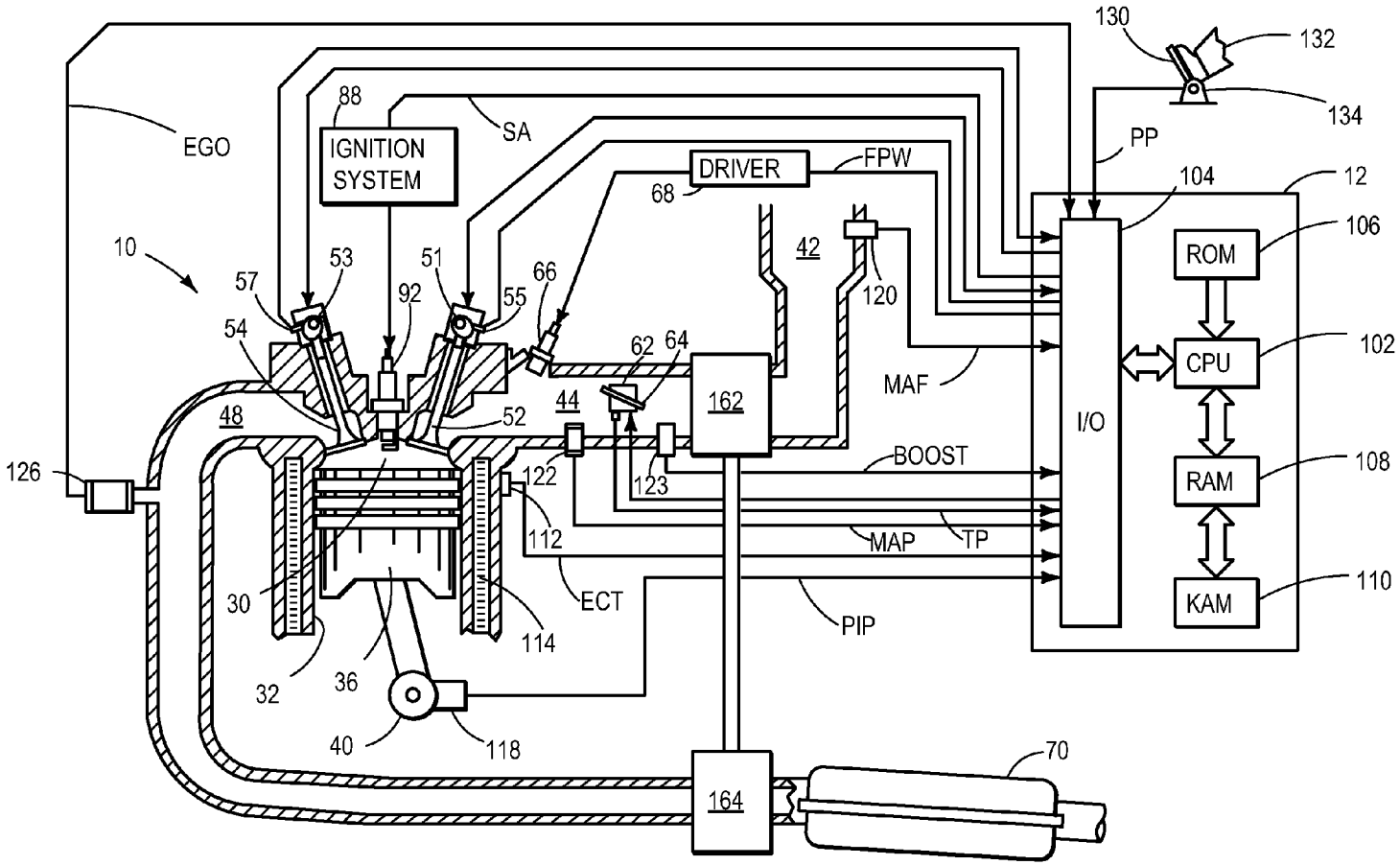
FIG. 1 schematically depicts an example of a cylinder of an internal combustion engine.
Figure 2:
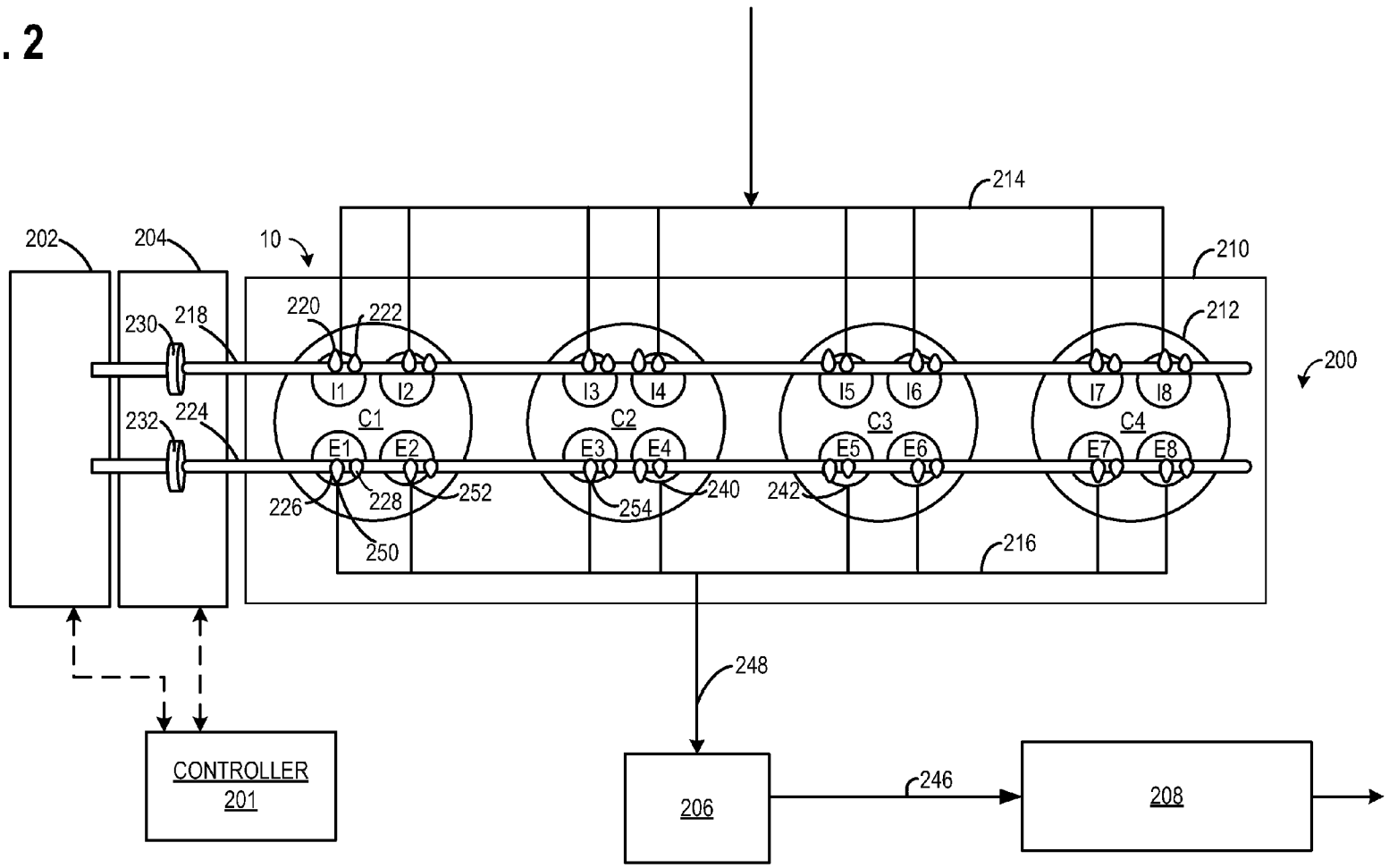
FIG. 2 shows a simplified internal combustion engine with multiple cylinders and an example cam actuation system.
Figure 3:
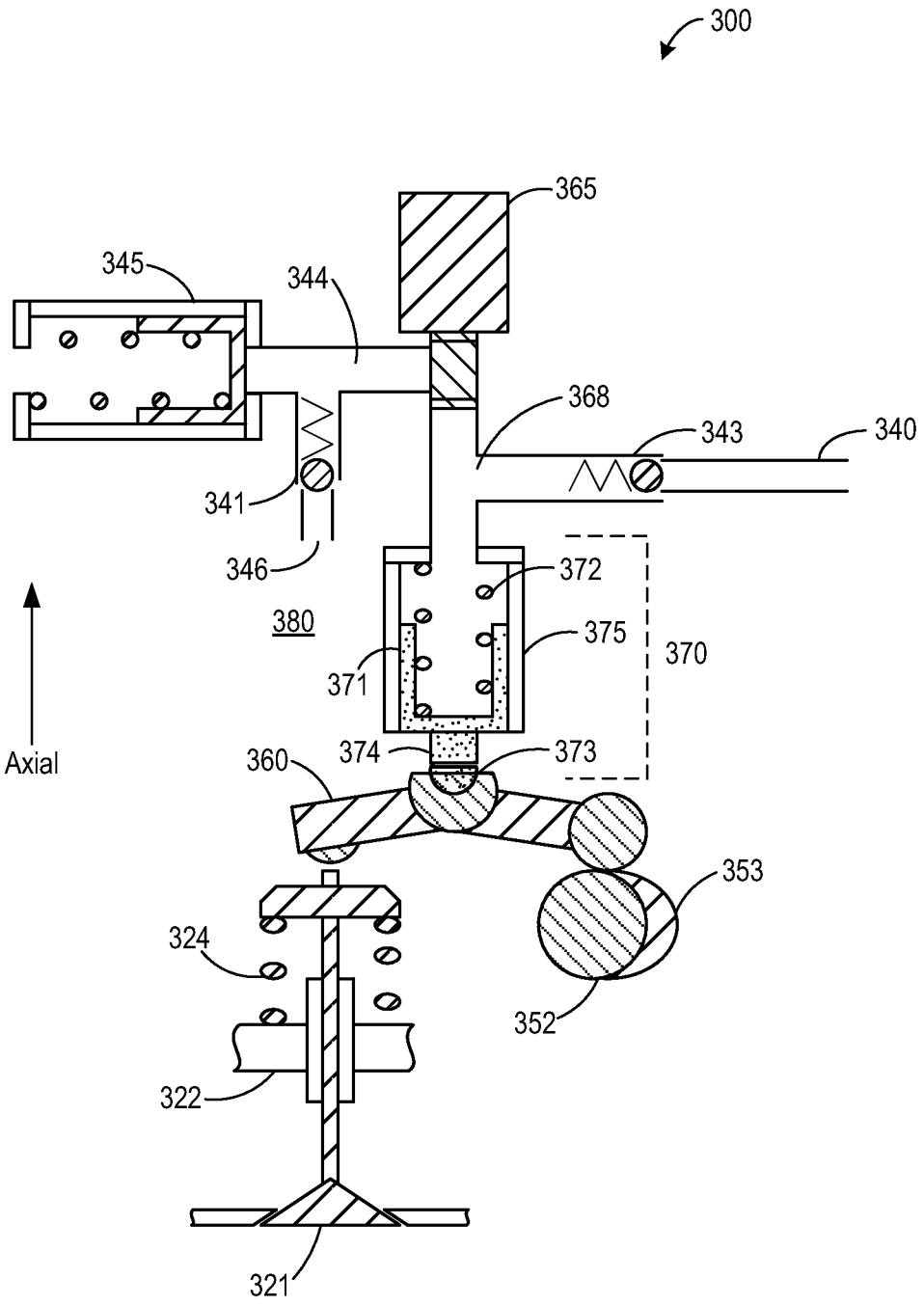
FIG. 3 shows an example of a hydraulic rolling cylinder deactivation system.
Figure 4:
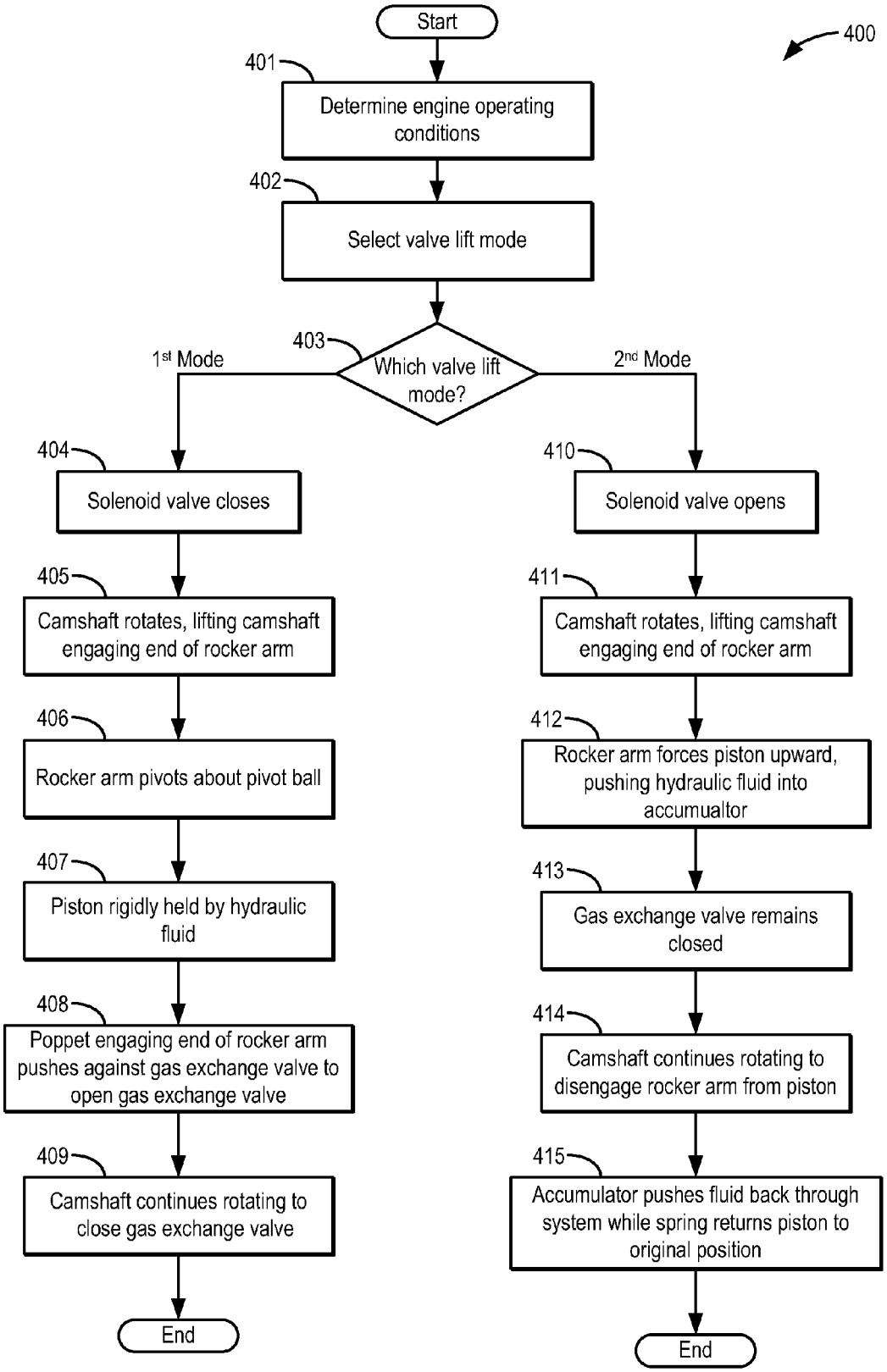
FIG. 4 depicts a flow chart of a method for operating a hydraulic rolling cylinder deactivation system.
Figure 5:
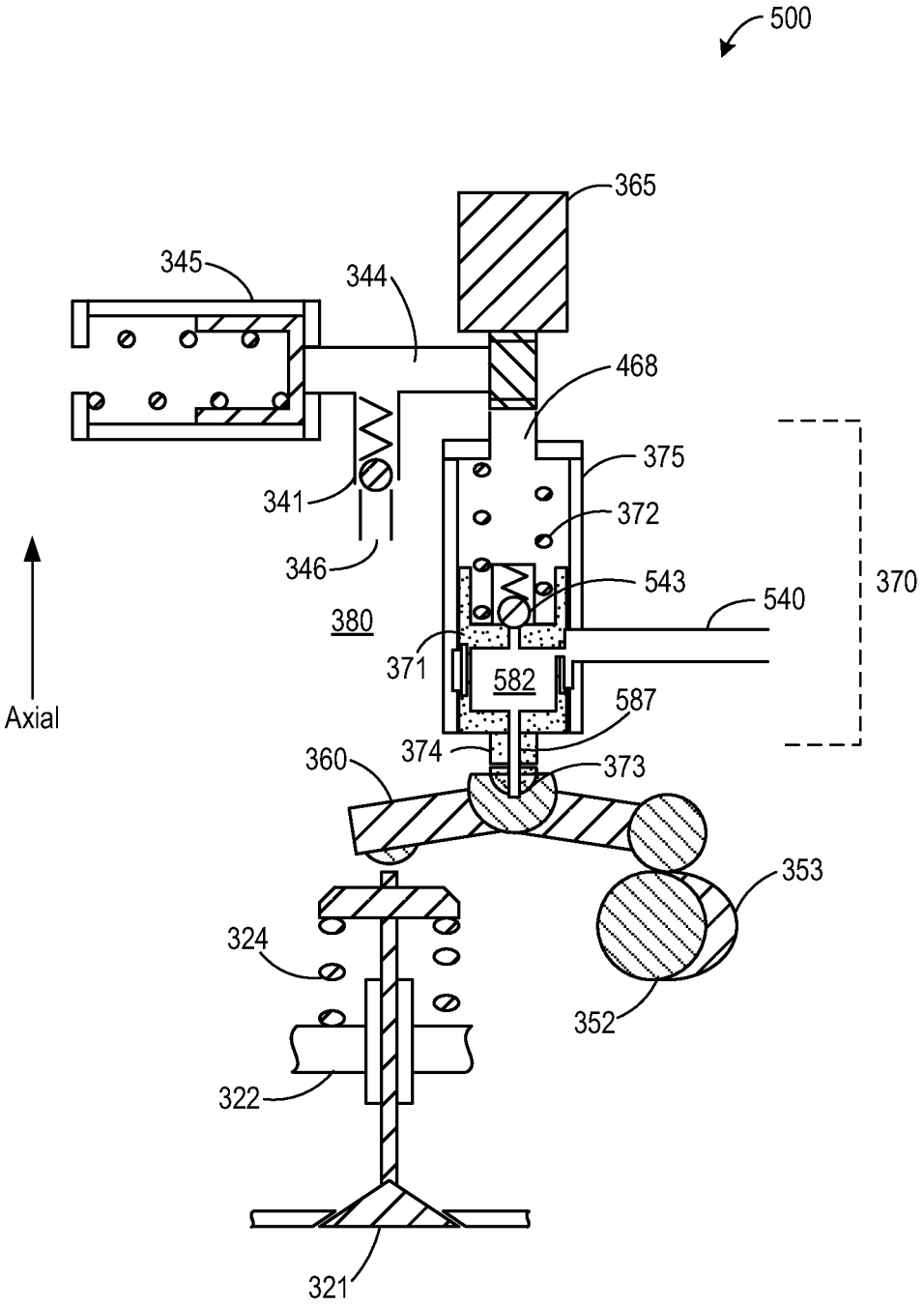
FIG. 5 shows another example of a hydraulic rolling deactivation system with additional oil lubrication.
Figure 6:
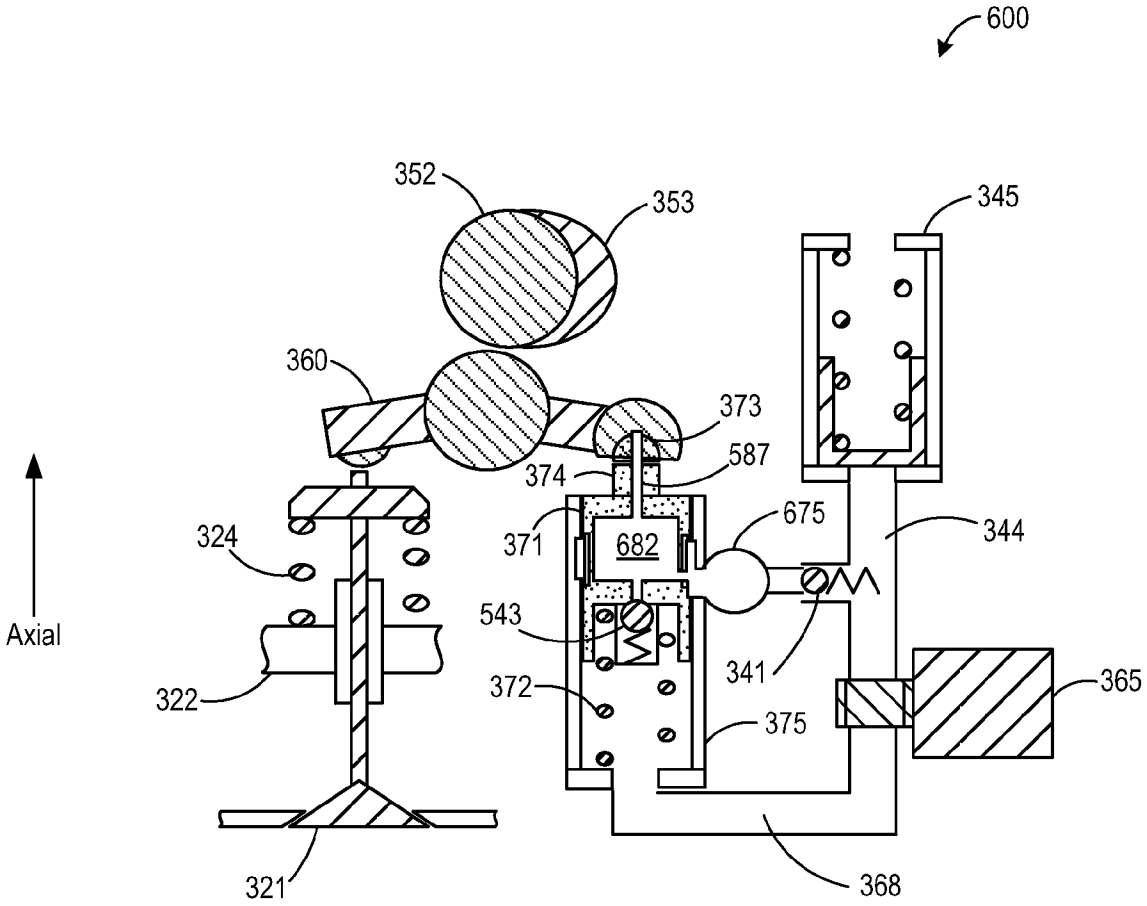
FIG. 6 shows a hydraulic rolling cylinder deactivation system with an end-pivot valvetrain configuration.
Figure 7:
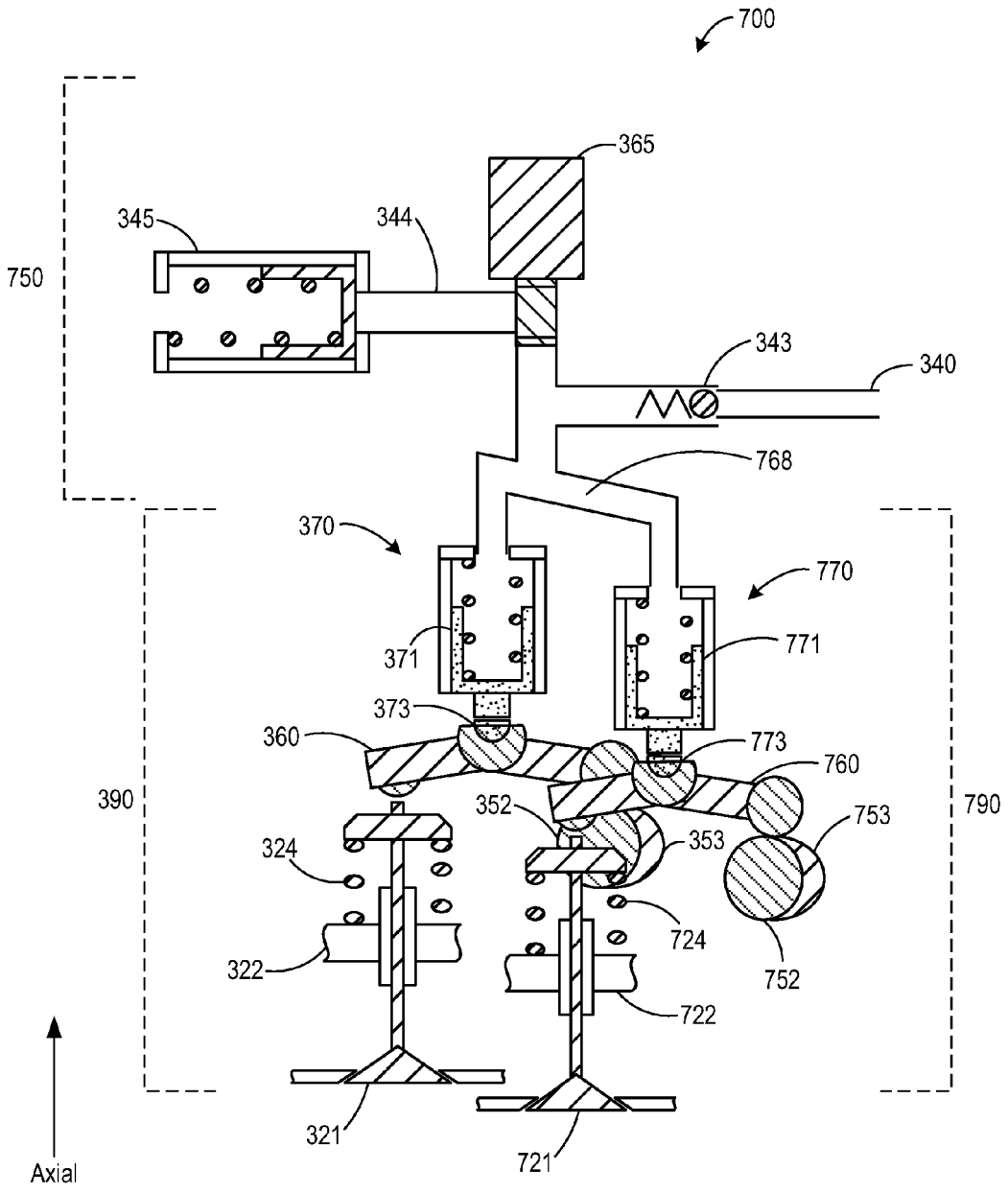
FIGS. 7-9 show hydraulic rolling cylinder deactivation systems to open and close multiple gas exchange valves.
Figure 8:
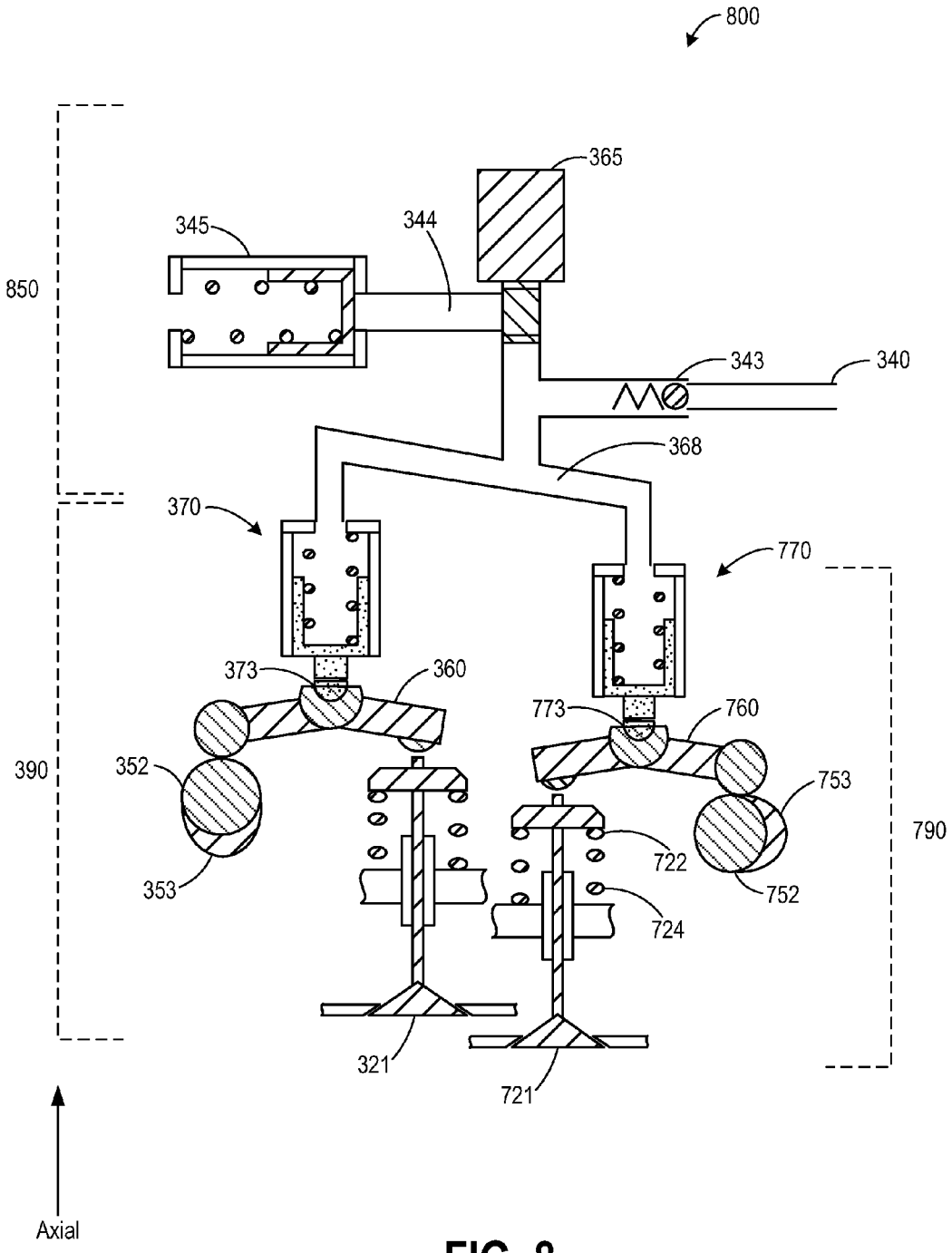
Figure 9:
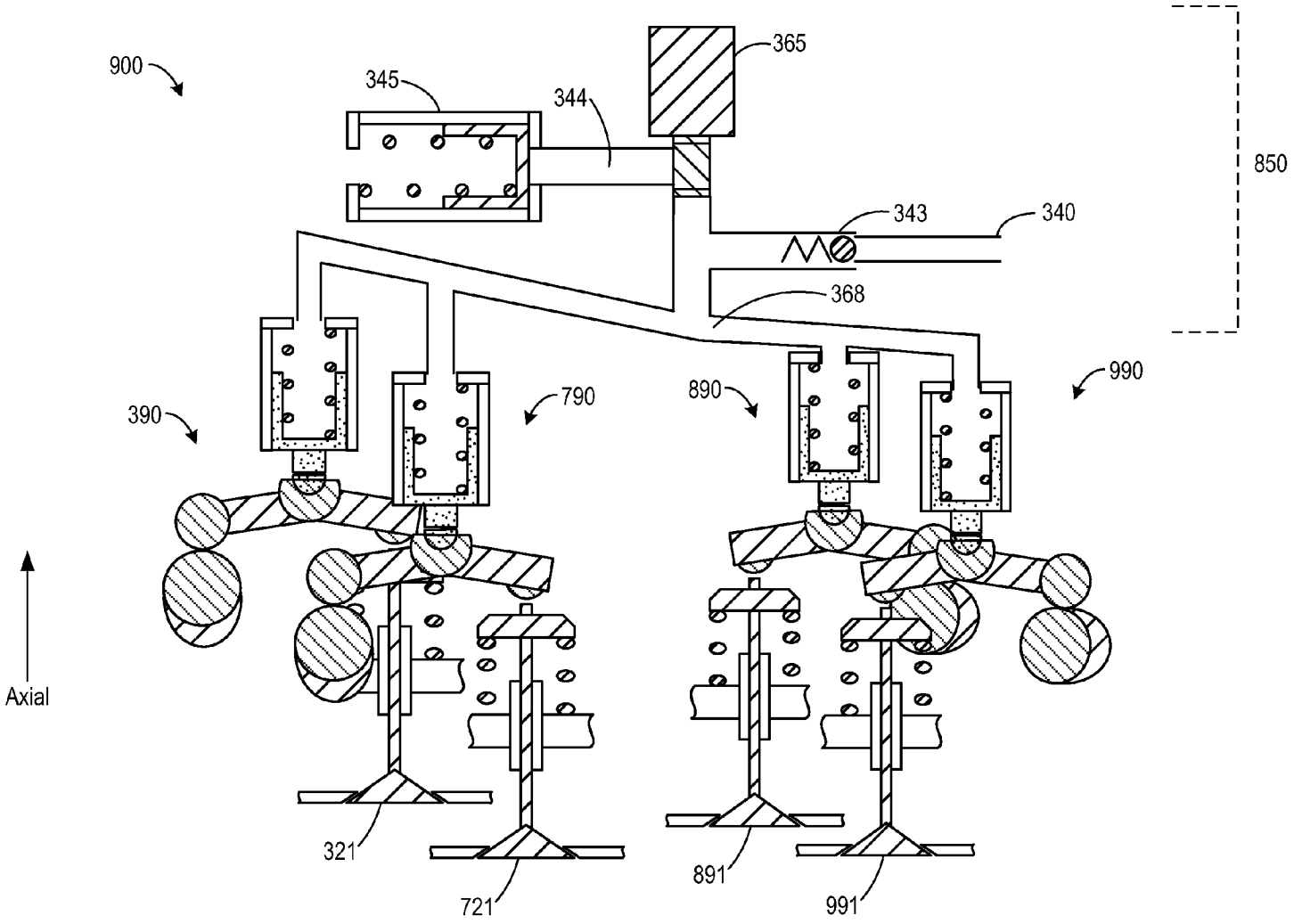
Figure 10:
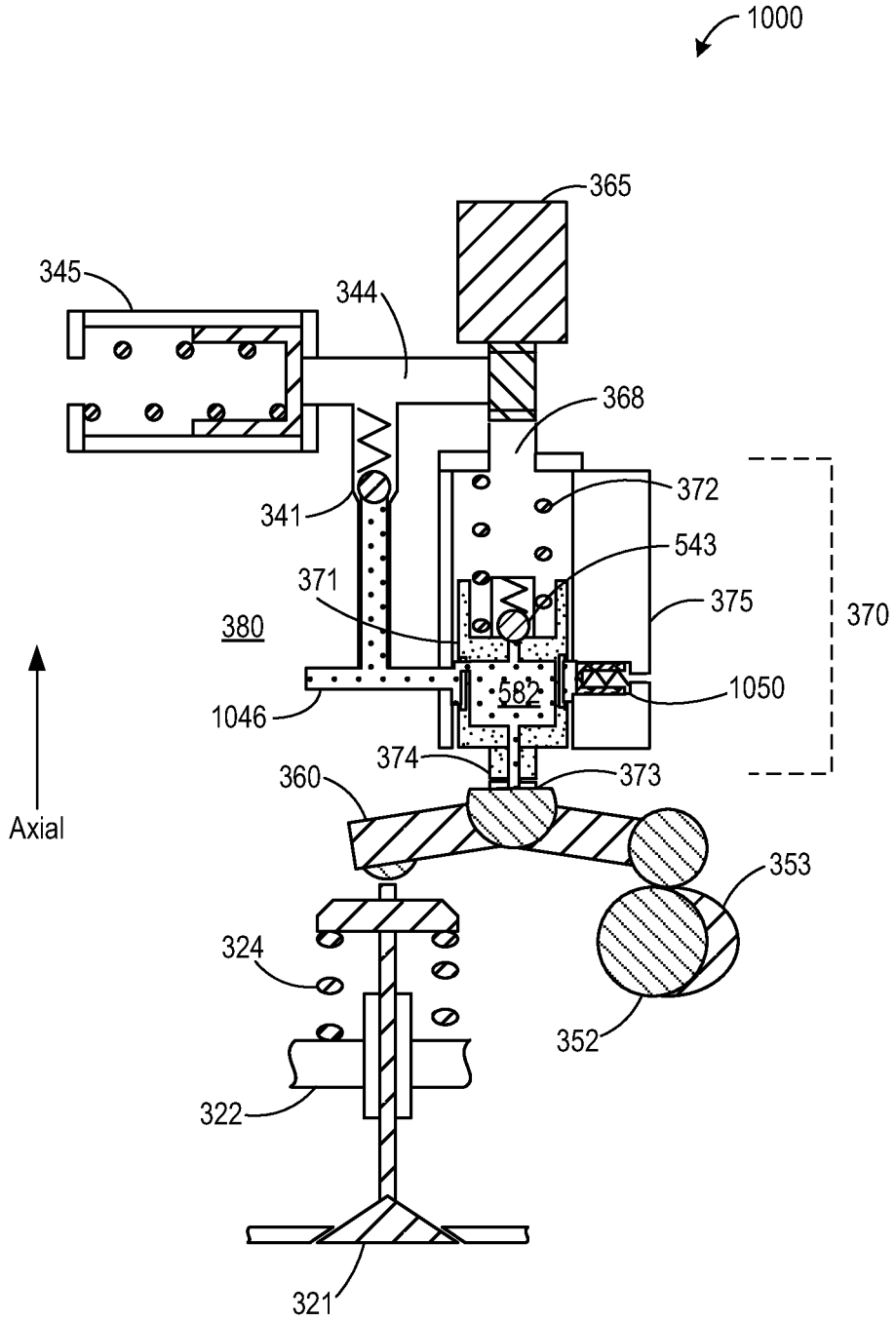
FIGS. 10-12 show hydraulic rolling cylinder deactivation systems with a latch pin and related components for reducing oil leakage.
Figure 11:
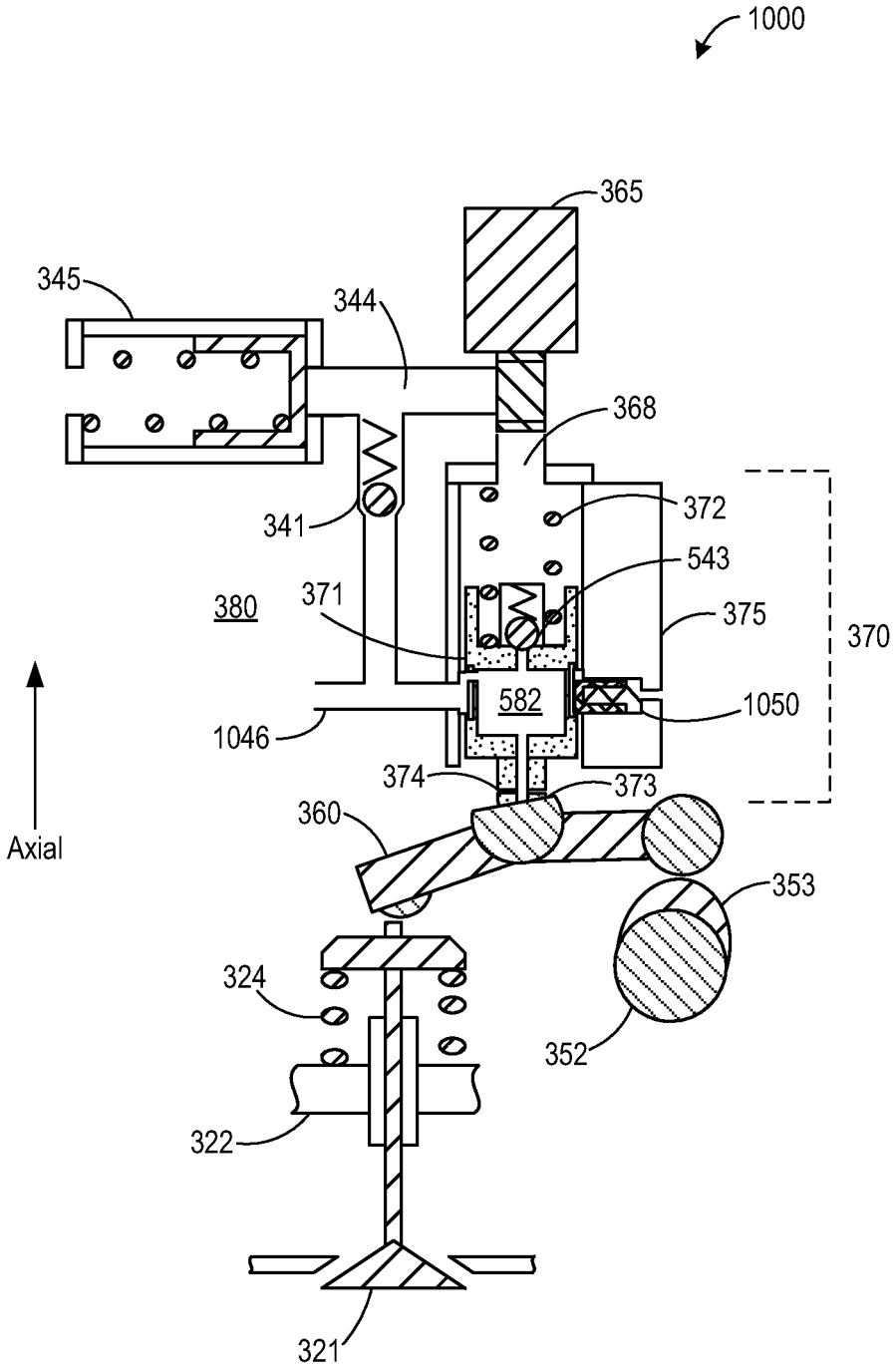
Figure 12:
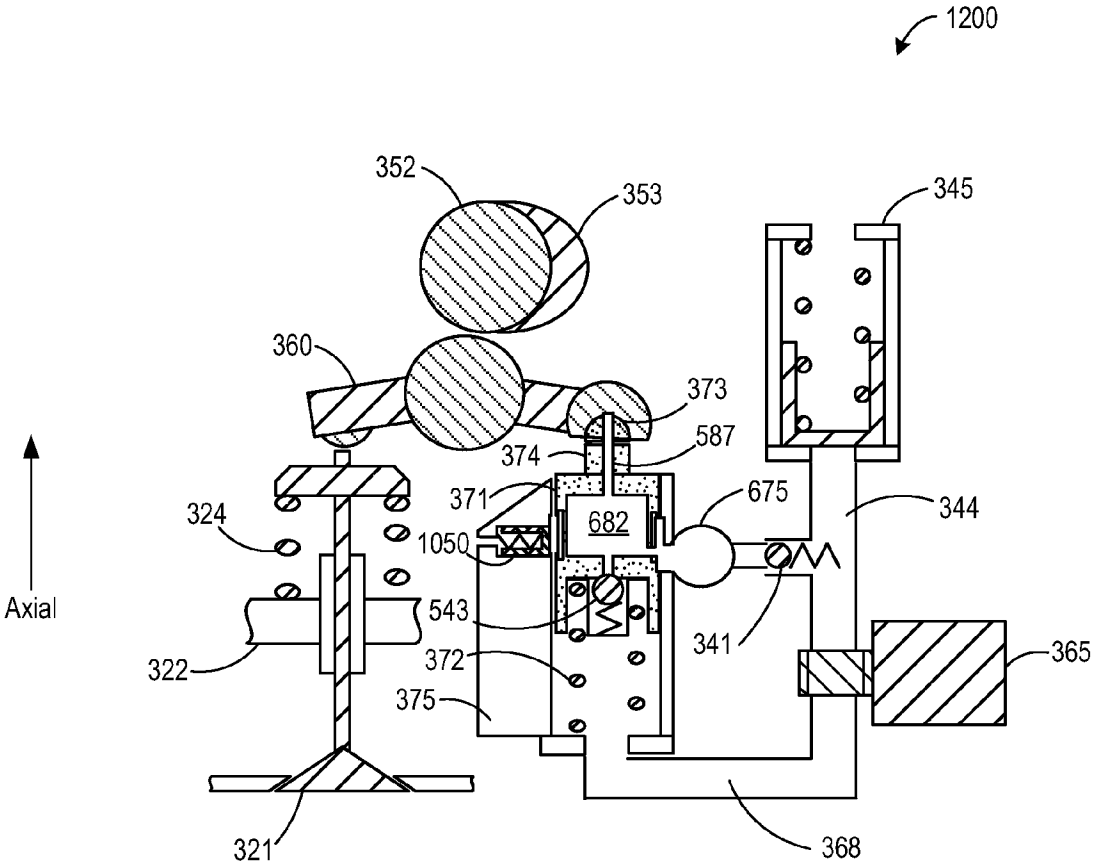
Figure 13:
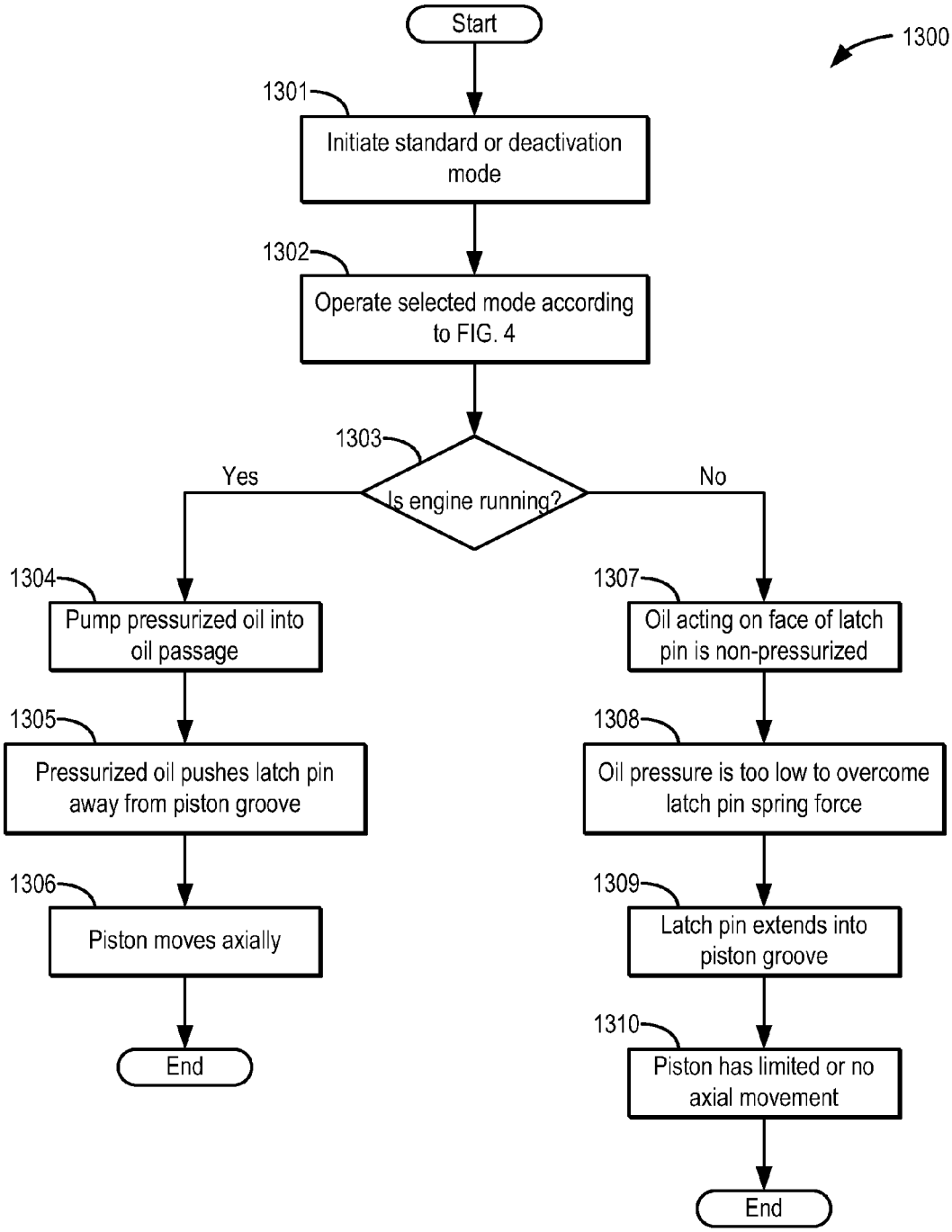
FIG. 13 depicts a flow chart of a method for operating a hydraulic rolling deactivation system with a latch pin.

1 while FIG. 2 shows a simplified internal combustion engine with an example cam actuation system. A hydraulic rolling cylinder deactivation system to selectively deactivate a gas exchange valve is shown in FIG. 3 that may be used with the engine of FIG. 1. FIG. 4 shows a flow chart for a method for operating the deactivation system of FIG. 3 and other similar systems. FIG. 5 shows another example of a deactivation system that may be used with the engine of FIG. 1, while FIG. 6 shows a deactivation system with an end-pivot valvetrain configuration that may be used with the engine of FIG. 1. FIGS. 7-9 show deactivation systems arranged to actuate more than one gas exchange valve. FIGS. 10-12 show deactivation systems with a latch pin to reduce oil leakage while FIG. 13 depicts a flow chart explaining operation of the deactivation systems of FIGS. 10-12. Again, such systems may be used with the engine of FIG. 1 as one example. Further, combinations of such systems may be used in an engine, such as one of the deactivation systems of FIG. 3 attached to a first cylinder and a second deactivation system attached to a second cylinder.

FIG. 1 depicts a schematic diagram showing one cylinder of multi-cylinder internal combustion engine 10. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Combustion cylinder 30 of engine 10 may include combustion cylinder walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion cylinder 30 may receive intake air from intake manifold 44 via intake passage 42 and may exhaust combustion gases via exhaust passage 48. Intake manifold 44 and exhaust passage 48 can selectively communicate with combustion cylinder 30 via respective intake valve 52 and exhaust valve 54. In some embodiments, combustion cylinder 30 may include two or more intake valves and/or two or more exhaust valves.

In this example, intake valve 52 and exhaust valve 54 may be controlled by cam actuation via respective cam actuation systems 51 and 53. Cam actuation systems 51 and 53 may each include one or more cams and may utilize one or more of cam profile switching (CPS), variable cam timing (VCT), valve deactivation (VDT), variable valve timing (VVT) and/or variable valve lift (VVL) systems that may be operated by controller 12 to vary valve operation. The position of intake valve 52 and exhaust valve 54 may be determined by position sensors 55 and 57, respectively or via camshaft sensors. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS, VDT, and/or VCT systems.

Combustion cylinder 30 includes a fuel injector 66 arranged in intake passage 42 in a configuration that provides what is known as port injection of fuel into the intake port upstream of combustion cylinder 30. Fuel injector 66 injects fuel therein in proportion to the pulse width of signal FPW received from controller 12 via electronic driver 68. Alternatively or additionally, in some embodiments the fuel injector may be mounted on the side of the combustion cylinder or in the top of the combustion cylinder, for example, to provide what is known as direct injection of fuel into combustion cylinder 30. Fuel may be delivered to fuel injector 66 by a fuel delivery system (not shown) including a fuel tank, a fuel pump, and a fuel rail.

Intake passage 42 may include a throttle 62 having a throttle plate 64. In this particular example, the position of throttle plate 64 may be varied by controller 12 via a signal provided to an electric motor or actuator included with throttle 62, a configuration that may be referred to as electronic throttle control (ETC). In this manner, throttle 62 may be operated to vary the intake air provided to combustion cylinder 30 among other engine combustion cylinders. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of catalytic converter 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. The exhaust system may include light-off catalysts and underbody catalysts, as well as exhaust manifold, upstream and/or downstream air-fuel ratio sensors. Catalytic converter 70 can include multiple catalyst bricks, in one example. In another example, multiple emission control devices, each with multiple bricks, can be used. Catalytic converter 70 can be a three-way type catalyst in one example.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. The controller 12 may receive various signals and information from sensors coupled to engine 10, in addition to those signals previously discussed, including measurement of inducted mass air flow (MAF) from mass air flow sensor 120; engine coolant temperature (ECT) from temperature sensor 112 coupled to water jacket 114 (i.e., a cooling sleeve); a profile ignition pickup signal (PIP) from Hall effect sensor 118 (or other type) coupled to crankshaft 40; throttle position (TP) from a throttle position sensor; and absolute manifold pressure signal, MAP, from sensor 122. Storage medium read-only memory 106 can be programmed with computer readable data representing instructions executable by processor 102 for performing the methods described below as well as variations thereof. The engine cooling sleeve 114 may be coupled to a cabin heating system.

Engine 10 may further include a compression device such as a turbocharger or supercharger including at least a compressor 162 arranged along intake manifold 44. For a turbocharger, compressor 162 may be at least partially driven by a turbine 164 (e.g., via a shaft) arranged along exhaust passage 48. For a supercharger, compressor 162 may be at least partially driven by the engine and/or an electric machine, and may not include a turbine. Thus, the amount of compression (e.g., boost) provided to one or more cylinders of the engine via a turbocharger or supercharger may be varied by controller 12. Further, a sensor 123 may be disposed in intake manifold 44 for providing a boost signal to controller 12.

Regarding engine 10 of FIG. 1, it is noted that various components may be added, removed, and/or changed according to specific engine embodiments. For example, the turbocharging system including compressor 162 and turbine 164 may be removed for engines that are naturally aspirated. In another example, for diesel engine applications, engine 10 may consume diesel as its fuel. Furthermore, spark plug 92 may be removed from FIG. 1 and other components such as a glow plug (not shown) may be included in the diesel embodiment of engine 10 to provide heat for cold starting the engine. Alternatively, for gasoline engines, a direct injection system may be added to engine 10, wherein a direct injector (not shown) may be provided in combustion cylinder 30 with appropriate controls from controller 12. These changes and others may be made while not departing from the scope of the present disclosure.

As mentioned previously, intake valve 52 and exhaust valve 54 may be controlled by cam actuation. As such, an example cam actuation system 200 is shown in FIG. 2, which may be used with engine 10 of FIG. 1, where engine 10 is also simply outlined in FIG. 2. Cam actuation system 200 may include a variable cam timing (VCT) system 202 and a cam profile switching (CPS) system 204, and/or other similar cam systems. Furthermore, a turbocharger 206, a catalyst 208, and a cylinder head 210 with a plurality of cylinders 212 may be present.

Engine 10 is shown having an intake manifold 214 configured to supply intake air and/or fuel to the cylinders 212 and an integrated exhaust manifold 216 configured to exhaust the combustion products from the cylinders 212. Exhaust manifold 216 may include an outlet 248 to couple to turbocharger 206 while an exhaust passage 246 may couple turbocharger 206 to catalyst 208. While in the embodiment depicted in FIG. 2, intake manifold 214 is separate from cylinder head 210 while exhaust manifold 216 is integrated in cylinder head 210, in other embodiments, intake manifold 214 may be integrated and/or exhaust manifold 216 may be separate from cylinder head 210.

Cylinder head 210 includes four cylinders, labeled C1-C4. Cylinders 212 may each include a spark plug and a fuel injector for delivering fuel directly to the combustion chamber, as described above in FIG. 1. However, in alternate embodiments, each cylinder may not include a spark plug and/or direct fuel injector. Cylinders may each be serviced by one or more valves. In the present example, cylinders 212 each include two intake valves and two exhaust valves. Each intake and exhaust valve is configured to open and close an intake port and exhaust port, respectively. The intake valves are labeled I1-I8 and the exhaust valves are labeled E1-E8. Cylinder C1 includes intake valves I1 and I2 and exhaust valves E1 and E2; cylinder C2 includes intake valves I3 and I4 and exhaust valves E3 and E4; cylinder C3 includes intake valves I5 and I6 and exhaust valves E5 and E6; and cylinder C4 includes intake valves I7 and I8 and exhaust valves E7 and E8. Each exhaust port of each cylinder may be of equal diameter. However, in some embodiments, some of the exhaust ports may be of different diameter.

Each intake valve is moveable between an open position allowing intake air into a respective cylinder and a closed position substantially blocking intake air from the respective cylinder. Further, FIG. 2 shows how intake valves I1-I8 may be actuated by a common intake camshaft 218. Intake camshaft 218 includes a plurality of intake cams configured to control the opening and closing of the intake valves. Each intake valve may be controlled by first intake cams 220 and second intake cams 222. Further, in some embodiments, one or more additional intake cams may be included to control the intake valves. In the present example, first intake cams 220 have a first cam lobe profile for opening the intake valves for a first intake duration. Further, in the present example, second intake cams 222 have a second cam lobe profile for opening the intake valve for a second intake duration. The second intake duration may be a shorter intake duration (shorter than the first intake duration), the second intake duration may be a longer intake duration (longer than the first duration), or the first and second duration may be equal. Additionally, intake camshaft 218 may include one or more null cam lobes. Null cam lobes may be configured to maintain respective intake valves in the closed position.

Each exhaust valve is moveable between an open position allowing exhaust gas out of a respective cylinder of the cylinders 212 and a closed position substantially retaining gas within the respective cylinder. Further, FIG. 2 shows how exhaust valves E1-E8 may be actuated by a common exhaust camshaft 224. Exhaust camshaft 224 includes a plurality of exhaust cams configured to control the opening and closing of the exhaust valves. Each exhaust valve may be controlled by first exhaust cams 226 and second exhaust cams 228. Further, in some embodiments, one or more additional exhaust cams may be included to control the exhaust valves. In the present example, first exhaust cams 226 have a first cam lobe profile for opening the exhaust valves for a first exhaust duration. Further, in the present example, second exhaust cams 228 have a second cam lobe profile for opening the exhaust valve for a second exhaust duration. The second exhaust duration may be a shorter, longer, or equal to the first exhaust duration. Additionally, exhaust camshaft 224 may include one or more null cam lobes. Null cam lobes may be configured to maintain respective exhaust valves in the closed position.

An integrated exhaust manifold 216, included within the engine cylinder head, may also be provided and configured with one or multiple outlets to selectively direct exhaust gas to various exhaust components. Integrated exhaust manifold 216 may include multiple separate exhaust manifolds, each having one outlet. Furthermore, the separate exhaust manifolds may be included in a common casting in cylinder head 210. In this present example, integrated exhaust manifold 216 includes the single outlet 248 coupled to turbocharger 206.

Additional elements not shown may further include push rods, rocker arms, hydraulic lasher adjusters, tappets, etc. Such devices and features may control actuation of the intake valves and the exhaust valves by converting rotational motion of the cams into translational motion of the valves. In other examples, the valves can be actuated via additional cam lobe profiles on the camshafts, where the cam lobe profiles between the different valves may provide varying cam lift height, cam duration, and/or cam timing. However, alternative camshaft (overhead and/or pushrod) arrangements could be used, if desired. Further, in some examples, cylinders 212 may each have only one exhaust valve and/or intake valve, or more than two intake and/or exhaust valves. In still other examples, exhaust valves and intake valves may be actuated by a common camshaft. However, in an alternate embodiment, at least one of the intake valves and/or exhaust valves may be actuated by its own independent camshaft or other device.

As described above, FIG. 2 shows a non-limiting example of cam actuation system and associated intake and exhaust systems. It should be understood that in some embodiments, the engine may have more or fewer combustion cylinders, control valves, throttles, and compression devices, among others. Example engines may have cylinders arranged in a "V" configuration. Further, a first camshaft may control the intake valves for a first group or bank of cylinders and a second camshaft may control the intake valves for a second group of cylinders. In this manner, a single cam actuation system may be used to control valve operation of a group of cylinders, or separate cam actuation systems may be used.

Internal combustion engines such as engine 10 may be designed to deliver enough power to meet the peak demands of the vehicle. However, during most engine operating conditions the vehicle requires much less power than its peak demand. As such, during low power conditions, the engine may run at low loads with relatively low efficiency. In a spark ignition engine, a main source of the inefficiency may be pumping loss due to the lower pressure acting on the pistons of the engine during the intake stroke versus the exhaust stroke. A common method for reducing pumping loss is to reduce the number of active (igniting or combusting) cylinders operating during low load operating conditions. This method may involve keeping both the intake and exhaust valves closed on the inactive cylinders. This method is known as cylinder deactivation, or a variable displacement (VD) engine mode, wherein one or more cylinders may be selectively deactivated via closing of intake and exhaust valves. In particular, valve deactivation occurs at the valvetrain level to enable variable displacement of the engine. In other words, valve deactivation is one type of cam actuation system that allows variable displacement engine modes to initiate.

Referring to FIG. 2, only a subset of the intake and exhaust valves of cylinders 212 may be deactivated, if desired, via one or more mechanisms according to a variable displacement engine mode. Cylinder deactivation may occur via switching tappets, switching rocker arms, or switching roller finger followers among other methods for deactivation. Some VD modes deactivate a particular set of cylinders every time deactivation is commanded. These modes may be referred to as fixed deactivation. Another type of VD mode, known as skip cylinder fire or rolling cylinder deactivation, involves rotating deactivation of cylinders rather than maintaining a fixed deactivated cylinder set. As an example, during low load engine conditions, cylinders C2 and C4 of FIG. 2 may be deactivated for a first period of time, then upon a command or condition requirement, the deactivation switches to the other cylinders C1 and C3. Rolling cylinder deactivation strategies may aid in improving vehicle fuel economy, and in some examples may increase fuel economy by at least 10%.

For cylinder deactivation strategies, including rolling cylinder deactivation, various mechanisms exist for decoupling intake and exhaust valves from the camshaft when lift is not required. Many of these mechanisms may include mechanical components that are subject to wear and other degradation during deactivation strategies, such as when cylinders are switching from active to inactive or vice versa. In particular, rolling cylinder deactivation systems may require a larger number of state switches compared to other deactivation strategies that deactivate a fixed subset of cylinders. The additional switches of rolling deactivation systems may cause durability issues with hardware that may be designed for fixed (more conventional) deactivation systems. Furthermore, many rolling deactivation systems may be more complex than fixed deactivation systems as more cylinders and cam actuation systems may be equipped with the components and control schemes needed for rolling deactivation.

The inventors herein have proposed a hydraulic rolling cylinder deactivation system that may be integrated with a number of different cylinder and cam actuation systems, as further described below. Hydraulic rolling deactivation systems may require fewer moving mechanical components than other similar systems since hydraulic force through rigid conduits provides actuation power in hydraulic systems rather than pure mechanical actuation. Furthermore, hydraulic rolling deactivation systems may draw hydraulic fluid from oil already provided to the engine by an oil pump. In this way, power to actuate the rolling deactivation systems may not be generated by a standalone source, instead being drawn from the oil pump.

FIG. 3 shows a first embodiment of a hydraulic rolling cylinder deactivation system 300, or more generally, a poppet valve operator 300. As seen, a camshaft 352 with an attached cam lobe 353 provides the force to move a gas exchange valve 321 in a linear fashion. Camshaft 352 may be either of camshafts 218 or 224 shown in FIG. 2. Furthermore, cam lobe 353 may be any of cams 220, 222, 226, or 228 shown in FIG. 3. In a similar fashion, hydraulic rolling deactivation system 300 may be integrated in cam actuation system 200 of FIG. 3. Deactivation system 300 provides deactivation for a center-pivot valvetrain, wherein a rocker arm 360 is placed in between cam lobe 353 and valve 321. Particularly, one end of the rocker arm 360, the poppet valve engaging end, is in direct contact with an end of the valve while the opposite end of the rocker arm 360, the camshaft engaging end, is in contact with the camshaft 352 through either a rolling or sliding interface.

The gas exchange valve 321 may be an intake or exhaust poppet valve of an engine, such as exhaust valves E1-E8 or intake valves I1-I8 of FIG. 2. Equivalently, gas exchange valve 321 may be either of valves 52 or 54 of FIG. 1. As seen in FIG. 3, valve 321 may be biased towards a closed position by a spring 324, where the closed position may substantially prevent a gas from entering or leaving the cylinder chamber. Also, valve 321 may be inserted into the cylinder chamber via a cylinder head 322. Spring 324 may be positioned in between cylinder head 322 and one end of the valve in order to bias the valve towards the closed position.

At substantially the center of the rocker arm in between the camshaft engaging end and the poppet valve engaging end a pivot pocket 373 is located, which may comprise a concave shape for fitting with a generally spherical, hydraulically operated pivot ball of a piston stem 374. The piston stem extends out from and is attached to a piston 371, where the diameter of the piston stem may be less than the diameter of the piston, as seen in FIG. 3. Piston 371 may be wholly contained in a housing 375, which may also guide and restrict the piston to move back and forth along an axial direction. Furthermore, a spring 372 is positioned on the backside of piston 371, the backside of the piston opposite to the end piston stem 374 is attached to. Spring 372 may be configured to bias the piston towards an original, extended first position, the position shown in FIG. 3. The combined structure of housing 375, piston 371 with piston stem 374, and spring 372 forms piston assembly 370, which may replace the function of a hydraulic lash adjuster in other cam actuation systems. In this way, the pivot ball of piston stem 374 may selectively engage pivot pocket 373 depending on the position of piston 371 as determined by spring 372 and pressure behind the piston, as explained in further detail below. Piston 371 and piston assembly 370 may more generally be a pivot ball actuator, wherein any suitable mechanism may be utilized to provide axial movement to the pivot ball.

As seen in FIG. 3, piston 371 may comprise a thin material such that a cavity occupies the backside of the piston. Housing 375 may contain an outlet in fluidic communication with a high pressure chamber 368, the outlet positioned such that a hydraulic fluid may enter the housing and enter the backside of the piston. High pressure chamber 368 may comprise a series of passages, single or multiple connected chambers, or another suitable geometry wherein the high pressure chamber remains isolated from an exterior environment 380, or the area outside the interior of the high pressure chamber and other system 300 components. High pressure chamber 368 may also be in fluidic communication with a check valve 343, where the check valve is positioned to substantially prevent backflow or fluid from escaping the high pressure chamber. Check valve 343 may allow pressurized fluid to enter high pressure chamber 368 from an oil gallery of a main fluid pump, represented by hydraulic (oil) passage 340. Depending on the setting of check valve 343, fluid at a threshold as determined by the setting of the check valve may enter high pressure chamber 368. Furthermore, high pressure chamber 368 may be in fluidic communication with a medium pressure chamber 344, the high and medium pressure chambers separated by a solenoid valve 365. The solenoid valve may be an electromechanically operated valve that is selectively opened and closed by an electric current through a solenoid contained in the valve. It is noted that the high and medium pressure chambers are labelled as such in relation to each other. In particular, when the solenoid valve 365 is closed to separate chambers 344 and 368, the pressure of fluid in chamber 368 may be higher than the pressure of fluid in chamber 344. As explained in further detail below, the pressure of fluid in chamber 368 may be generally higher than the pressure of fluid in chamber 344.

Similar to high pressure chamber 368, medium pressure chamber 344 may be in fluidic communication with another check valve 341 positioned to substantially prevent backflow or fluid from escaping the medium pressure chamber. Also, check valve 341 may be set to allow fluid with a threshold pressure to enter medium pressure chamber 344 from a hydraulic (oil) passage 346 through which fluid may flow from the gallery of the main fluid pump. Furthermore, the medium pressure chamber may be fluidically coupled to an accumulator 345. Accumulator 345 may be a type of pressure storage reservoir where fluid may be held under pressure by a source such as a spring. As seen in FIG. 3, a spring is used as the source in accumulator 345. Fluid in medium pressure chamber 344 may push against a surface within accumulator 345 in order to compress the spring to maintain pressure in the fluid. It is noted that the fluid entering system 300 may be a hydraulic fluid such as engine oil supplied by the engine oil pump (main fluid pump) via passages 340 and 346 and check valves 343 and 341.

When solenoid valve 365 is in a first or closed position, fluid may be substantially prevented from traveling between chambers 344 and 368. Alternatively, when the solenoid valve is in a second or open position, fluid may travel freely between the coupled high and medium pressure chambers 368 and 344, respectively, thereby creating a continuous, single pressure chamber. During operation of solenoid valve 365 and accumulator 345 while oil flows through chambers 344 and 368 and into the backside of piston 371, hydraulic fluid (oil) may be lost through leakage between the various components of system 300. Furthermore, oil may also be lost whenever rocker arm 360 is in contact with cam lobe 353, whereupon pressure increases in chamber 368 as well as in chamber 344 when solenoid valve 365 is open. As such, to maintain oil level and pressure, oil may be replenished by the oil pump via passages 340 and 346. To not disrupt pressures inside chambers 344 and 368 during operation of system 300 as further described below, oil may be replenished through check valves 341 and 343 when camshaft 352 is in a base circle phase. The base circle phase may be when lobe 353 is not in contact with rocker arm 360.

One of the main objectives of rolling cylinder deactivation system 300 is to selectively rigidly engage the pivot ball of piston stem 374 with pivot pocket 373. When the pivot ball and pivot pocket are in rigid contact, then as cam lobe 353 pushes against the camshaft engaging end of rocker arm 360, the center of the rocker arm can pivot about the rigid pivot ball, thereby causing the rocker arm to push valve 321 linearly into an open position. In this case, rigid contact and rigid engagement between the pivot ball of piston stem 374 and pivot pocket 373 refer to whether or not piston 371 (and the pivot ball) is held against pivot pocket 373 without substantially moving within piston housing 375. For example, as described in more detail below, if enough pressure is present inside housing 375 in the backside cavity of piston 371, then the pivot ball may be held against pivot pocket 373 with sufficient force (rigid engagement) so rocker arm 360 can rotate about the pivot ball in order to actuate valve 321. Alternatively, if a pressure lower than the required amount is present behind the piston (flexible engagement), then as the cam lobe pushes against one end of the rocker arm, the piston (and pivot ball) may move only axially (or linearly) towards the solenoid valve, causing the rocker arm to also move in the same generally linear direction rather than purely rotating about pivot pocket 373 to move valve 321 to the open position. As such, the pressure behind piston 371 as controlled by the various components of FIG. 3 may determine whether or not valve 321 opens.

The rolling cylinder deactivation system of FIG. 3 may be configured to operate in two valve lift modes. The first mode may be a standard lift mode, wherein the piston is held in rigid engagement with the pivot pocket 373 of the rocker arm 360. This mode includes standard operation of the valvetrain, wherein cam lobe 353 causes rotation of the rocker arm in order to open and close gas exchange valve 321. During this mode, solenoid valve 365 may be closed such that the high and medium pressure chambers are fluidically separated. As such, high pressure chamber 368 is isolated and may maintain a high, holding pressure of the fluid that is also in contact with the backside of piston 371. Therefore, as cam lobe 353 pushes against the camshaft engaging end of rocker arm 360, the general incompressibility of the fluid may hold piston 371 in its extended first, rigid position (rigid engagement), thereby allowing the rocker arm to pivot and open the gas exchange valve. As the cam lobe continues rotating about the camshaft, the rocker arm may pivot in the opposite direction so that the gas exchange valve closes.

The second mode of the rolling cylinder deactivation system may be a deactivation mode, wherein the piston is held in flexible engagement with the pivot pocket 373 of the rocker arm 360. This mode causes gas exchange valve 321 to remain closed as cam lobe 353 revolves and pushes against rocker arm 360. During this mode, solenoid valve 365 may be open such that the high and medium pressure chambers are fluidically connected. As such, high pressure chamber 368 is connected to medium pressure chamber 344 along with accumulator 345. Therefore, as cam lobe 253 pushes against the camshaft engaging end of rocker arm 360, piston 371 is forced toward the solenoid valve, thereby forcing fluid from the high and medium pressure chambers into accumulator 345. Compared to the first mode, during the second mode the fluid may no longer rigidly hold the piston rigidly in place, thereby allowing the piston to move toward the solenoid valve to a compressed, second position while remaining in contact with rocker arm 360 via pivot pocket 373 (flexible engagement). In this way, the center of the rocker arm moves generally in the direction of the piston instead of rotating about the pivot ball of piston stem 374. Therefore, the poppet valve engaging end of the rocker arm may not actuate valve 321, leaving the valve in the closed position and deactivating the cylinder valve 321 is contained in. Finally, as the cam lobe continues rotating about the camshaft, the accumulator may push fluid back into the high and medium pressure chambers while the piston returns from the compressed, second position to its extended, first position as determined by spring 372. In summary, during the deactivation mode, opening the solenoid valve 365 may allow the motion of cam lobe 353 to move piston 371, the hydraulic fluid, and accumulator 345 rather than opening the gas exchange valve 321.

Compared to some deactivation systems, hydraulic rolling deactivation system 300 of FIG. 3 may leverage several advantages. System 300 includes simple, mechanical components such as accumulator 345 and high pressure chamber 368 to enable switching between the standard lift mode and deactivation mode, which may increase reliability of system 300 compared to other, more complex deactivation systems that utilize more electronic control. In particular, system 300 may include a single solenoid valve 365 that receives a single input signal for selectively separating or combining medium and high pressure chambers (368 and 344) for switching between standard lift and deactivation modes, as previously described. Besides commanding the solenoid valve 365, no further electronic control may be applied to system 300, as the other components of system 300 function as a result of activation or deactivation of solenoid valve 365.

FIG. 4 shows an example method 400 of operating the rolling deactivation system 300 of FIG. 3. Method 400 may involve a series of steps, some of which may be executed by a vehicle controller, such as controller 12 of FIG. 1 that is in electronic communication with solenoid valve 365. Particularly, in the current example, the controller may send signals to solenoid valve 365 for commanding the valve to either an energized, activated (open) position or a de-energized, deactivated (closed) position. Conversely, in some examples, the energized position may be the closed position while the de-energized position may be the open position. As system 300 is a mechanically-operated system with the exception of solenoid valve 365 being connected to the controller, some of the steps of method 400 may occur as a result of operation of solenoid valve 365 without being directly commanded by the controller. In other words, controller 12 may be connected to rolling deactivation system 300 via only solenoid valve 365. In particular, as described in further detail below, steps 401-404 and 410 may be performed by the controller while steps 405-409 and 411-415 may occur as a result of the closing or opening of solenoid valve 365 and/or rotation of the engine while it is turned on.

First, at 401, the method includes determining a series of engine operating conditions. The conditions may include measuring the temperature of engine oil provided to passages 340 and 346, determining engine speed, determining engine load or torque, determining camshaft 352 position for accurate timing of solenoid valve 365, and calibrating solenoid valve 365. Furthermore, step 401 may include determining during what conditions the first and second modes are desired. In particular, the first or standard lift mode, wherein valve 321 is normally operated to allow gas to flow to or from the respective cylinder, may be desired when the engine is operating above a threshold load. Alternatively, the second or deactivation mode, wherein valve 321 remains closed to deactivate the respective cylinder, may be desired when the engine is operating below the threshold load. In this way, fuel may be saved during low-load engine operation when a lower amount of power is produced when one or more cylinders are deactivated according to the second mode. Next, at 402, depending on the conditions selected in 401, the method includes selecting a valve lift mode to execute. The valve lift mode (first or second mode) may be selected (commanded) by controller 12. Subsequently, at 403, the controller may determine which valve lift mode was selected at 402. If the first or standard valve lift mode was selected, then method 400 continues at 404. Alternatively, if the second or deactivation valve lift mode was selected, then method 400 continues at 410.

At 404, the controller may send a signal to solenoid valve 365 to de-energize (deactivate) the valve to the closed position, wherein medium pressure chamber 344 and high pressure chamber 368 are fluidically separated. Upon closing of the solenoid valve, at 405 camshaft 352 may rotate in accordance with the speed of the engine. As the camshaft 352 rotates, lobe 353 may push against the camshaft engaging end of rocker arm 360. Due to the pushing force exerted from lobe 353 to rocker arm 360, at 406 rocker arm 360 may rotate about pivot ball of piston stem 374. As rocker arm 360 rotates and pushes piston stem 374 and piston 371 in the axial direction, at 407 piston 371 may be held in the first position by hydraulic fluid trapped in high pressure chamber 368 and behind piston 371. Since solenoid valve 365 was closed at 404, the fluid in high pressure chamber 368 may not escape, and as hydraulic fluid may be substantially incompressible (i.e., non-elastic), piston 371 may not displace in the axial direction. In this way, at 408, rocker arm 360 may complete its pivoting rotation about the pivot ball of stem 374, thereby pushing against gas exchange valve 321 to open the gas exchange valve, allowing gas to enter or exit the respective combustion chamber of the cylinder. Finally, at 409, camshaft 352 may continue to rotate to disengage lobe 353 from the camshaft engaging end of rocker arm 360, thereby closing gas exchange valve 321 according to combustion sequence timing of the engine. In this way, gas exchange valve 321 operates normally according to the standard lift mode as long as solenoid valve 365 remains in the de-energized (closed) position.

In the alternative case of 403, the second or deactivation mode may be selected and the method 400 proceeds at 410. At 410, the controller may send a signal to solenoid valve 365 to energize (activate) the valve to the open position, wherein medium pressure chamber 344 and high pressure chamber 368 are fluidically coupled. The coupling between the chambers 344 and 368 effectively creates a single chamber with the same pressure throughout. Upon opening of the solenoid valve, at 411 camshaft 352 may push against the camshaft engaging end of rocker arm 360. Due to the pushing force exerted from lobe 353 to rocker arm 360, at 412 rocker arm 360 may force piston 371 in the axial (upward) direction to the second position, thereby pushing hydraulic fluid through chambers 368 and 344 and into accumulator 345. The hydraulic fluid may act against a spring or other mechanism inside accumulator 345 to allow piston 371 to move axially. As such, at 413, gas exchange valve 321 remains closed since rocker arm 360 may move in the axial direction with piston 371 instead of rotating about the pivot ball of piston stem 374. Next, at 414, camshaft 352 may continue to rotate such that lobe 353 is no longer in contact with the camshaft engaging end of the rocker arm 360, thereby reducing the force between piston 371 and rocker arm 360. In particular, pivot pocket 373 (of rocker arm 360) may decrease an axial force provided to the pivot ball of piston stem 374, part of piston 371. Finally, at 415, accumulator 345 may push hydraulic fluid back through chambers 344 and 368 into the region behind piston 371 while spring 372 may return piston 371 to the first position. In other words, while physical contact remains between pivot pocket 373 and the pivot ball of piston stem 374, the axial forces between the components reduce to allow the parts to return to the first position of piston 371. In this way, the gas exchange valve 321 may remain closed according to the deactivation mode as long as solenoid valve 365 remains in the energized (open) position.

It is noted that other schemes are possible for operating hydraulic rolling cylinder deactivation system 300. For example, another solenoid valve may be included in the system and electronically operated to aid in deactivation of valves 321. In another example, system 300 may further include additional oil passages and/or accumulators and other components to provide additional valve deactivation modes or other valvetrain operating modes. As such, modifications may be made to system 300 of FIG. 3 as well as method 400 of FIG. 4 without departing from the scope of the present disclosure.

Another embodiment of a rolling cylinder deactivation system 500 is shown in FIG. 5. Many devices and/or components in the system of FIG. 3 are the same as devices and/or components shown in FIG. 5. Therefore, for the sake of brevity, devices and components of the system of FIG. 5, and that are included in the system of FIG. 3, are labeled the same and the description of these devices and components is omitted in the description of FIG. 5.

System 500 appears similar to system 300 of FIG. 3 as well as operates in the same general way according to method 400 of FIG. 4. However, as in seen in FIG. 5, system 500 includes check valve 543 located on the backside of piston 371, the check valve separating the backside of the piston from a piston interior 582 formed by a concave region inside the piston 371 and enclosed by the piston material. The piston interior 582 or lubrication chamber, being connected to check valve 543, may also be in fluidic communication with a passage 540. The passage 540 may carry hydraulic fluid such as lubricating fluid from an oil gallery to interior 582. Furthermore, piston interior 582 may be coupled to a lubricating passage 587 located inside piston stem 371 and connecting interior 582 to the pivot ball, pivot pocket 373, and the interface in between the pivot ball and pivot pocket 373. The pivot ball may have a generally spherical shape to fit inside pivot pocket 373 to form a type of ball-socket joint, wherein rocker arm 360 can pivot about the pivot ball. As such, lubrication of the interface between the pivot ball and pivot pocket 373 may be desirable to delay degradation of the components of system 500. Additionally, passage 540 may be positioned adjacent to piston housing 375 such that as piston 371 reciprocates back and forth along the axial direction, passage 540 remains in fluidic communication with interior 582. Alternatively, during a portion of the piston's stroke, fluidic communication between passage 540 and interior 582 may be temporarily interrupted.

Yet another embodiment of a rolling cylinder deactivation system 600 is shown in FIG. 6. Many devices and/or components in the system of FIG. 6 are the same as devices and/or components shown in FIG. 5. Therefore, for the sake of brevity, devices and components of the system of FIG. 6, and that are included in the system of FIG. 5, are labeled the same and the description of these devices and components is omitted in the description of FIG. 6.

The rocker arm 360-piston 371 configurations shown in FIGS. 3 and 5 are commonly referred to as part of a center-pivot valvetrain, wherein the pivot pocket 373 is substantially centrally located on rocker arm 360. In other valvetrains, pivot pocket 373 may be located at an end of the rocker arm 360. In particular, pivot pocket 373 may be located at the end of the rocker arm 360 opposite the poppet valve engaging end. Such rocker arm-piston configurations are commonly referred to as part of an end-pivot valvetrain. In end-pivot configurations, the camshaft engaging end of rocker arm 360 may be replaced with a pivot ball engaging end to allow the cam lobe 353 to contact the rocker arm 360 in between the pivot ball engaging end and poppet valve engaging end. Deactivation system 600 reflects an example of an end-pivot valvetrain.

As seen in FIG. 6, system 600 includes the components of FIG. 5, arranged in a different configuration to conform to the end-pivot valvetrain. In particular, camshaft 352 engages substantially the center of rocker arm 360 rather than an end of the rocker arm. Furthermore, with the same axial orientation as seen in the preceding figures, piston 371 moves between its compressed and extended positions in opposite axial directions compared to the piston movement in FIGS. 3 and 5. Specifically, piston 371 compresses opposite to the axial direction (negative axial) in FIG. 6 whereas piston 371 compresses in the axial direction in FIGS. 3 and 5. In accordance with the flipped orientation of piston 371 and associated components, chambers 368 and 344 along with accumulator 345 and solenoid valve 365 are positioned differently. However, method 400 may still be applied to the deactivation system 600, wherein the camshaft engaging end of rocker arm 360 is replaced by pivot pocket 373 in FIG. 6. Furthermore, the camshaft engaging end may move to the center of rocker arm 360 in FIG. 6.

Deactivation system 600 may also include a passage 675 in fluidic communication with the oil gallery for providing lubricating oil (or other fluid) to interior 682 as well as to chambers 344 and 368. In this example, instead of including two separate passages leading to the oil gallery, the single passage 675 may provide oil to the deactivation system 600. In alternative embodiments, passage 675 may be replaced by the oil gallery directly. Also, similar to system 500 of FIG. 5, lubricating passage 587 may be included to provide oil to the pivot ball and interface.

Description will now be provided regarding applying the deactivation system 300 of FIG. 3 to additional gas exchange valves such that one solenoid valve 365 may operate multiple gas exchange valves. FIGS. 7-10 provide several example embodiments of rolling cylinder deactivation systems similar to system 300 but configured to open and close more than one valve.

A dual valve rolling cylinder deactivation system 700 is shown in FIG. 7. Many devices and/or components in the system of FIG. 7 are the same as devices and/or components shown in FIG. 3. Therefore, for the sake of brevity, devices and components of the system of FIG. 7, and that are included in the system of FIG. 3, are labeled the same and the description of these devices and components is omitted in the description of FIG. 7.

Dual valve deactivation system 700 includes a first piston assembly 370 and a second piston assembly 770, each coupled to separate rocker arms 360 and 760 and well as separate gas exchange valves 321 and 721, respectively. Furthermore, the first piston assembly 370 may be included in a first valvetrain system 390 while the second piston assembly 770 may be included in a second valvetrain system 790 as seen in FIG. 7. Furthermore, first and second valvetrain systems 390 and 790 may be jointly controlled via a common control system 750. The control system 750 may include components such as the medium pressure chamber 344, accumulator 345, solenoid valve 365, and check valve 343. A common high pressure passage 768 may fluidically connect valvetrain systems 390 and 790 to control system 750.

As seen, a single control system 750 may simultaneously and jointly actuate more than one valvetrain system and gas exchange valve. For example, the execution of method 400 may selectively open and close gas exchange valves 321 and 721 in unison according to the first and second modes. In this embodiment, camshafts 352 and 752 may rotate in unison such that lobes 353 and 753 also rotate in unison to open and close valves 321 and 721 in unison. In this way, since a single control system 750 can engage the standard lift and deactivation modes of more than one valve, cost of system 700 may be lower compared to other systems. It is noted that gas exchange valves 321 and 721 may both be intake valves or exhaust valves or one of each. In another embodiment, camshafts 352 and 752 may be the same camshaft, wherein lobes 353 and 753 are located at different positions along the length of the camshaft. Furthermore, in some embodiments, lobes 353 and 753 may have different shapes to provide different lift heights, lift durations, and/or lift phasing to gas exchange valves 321 and 721, respectively.

A variation of dual valve rolling deactivation system 700 is shown in FIG. 8, labelled as dual valve rolling deactivation system 800. Many devices and/or components in the system of FIG. 8 are the same as devices and/or components shown in FIG. 7. Therefore, for the sake of brevity, devices and components of the system of FIG. 8, and that are included in the system of FIG. 7, are labeled the same and the description of these devices and components is omitted in the description of FIG. 8.

Dual deactivation system 800 is identical to system 700 of FIG. 7 with the exception of the relative placement of first valvetrain system 390 and second valvetrain system 790. Compared to FIG. 7, first valvetrain system 390 of FIG. 8 is mirrored such that camshafts 352 and 752 are located farther apart than in FIG. 8. Furthermore, high pressure chamber 368 may have a longer or changed shape to accommodate the spacing between systems 390 and 790. Still, a single control system 850 with one solenoid valve 365 and one accumulator 345 may be configured to selectively provide pressurized hydraulic fluid to high pressure chamber 368 in order to rigidly or non-rigidly hold pistons 371 and 771. Also, due to the positions of valvetrain systems 390 and 790, valve 321 may be an intake valve while valve 721 may be an exhaust valve, or vice versa.

A four-valve rolling deactivation system 900 is shown in FIG. 9. Many devices and/or components in the system of FIG. 9 are the same as devices and/or components shown in FIG. 7. Therefore, for the sake of brevity, devices and components of the system of FIG. 9, and that are included in the system of FIG. 7, are labeled the same and the description of these devices and components is omitted in the description of FIG. 9.

Extending the concept explained with regard to FIG. 7, four valves may be deactivated via a single control system 950. First and second valvetrain systems 390 and 790, as previously presented, may be included in system 900 in addition to third valvetrain system 890 and fourth valvetrain system 990. Also, high pressure chamber 368 may be extended to fluidically attach to each of systems 390, 790, 890, and 990. In this way, control system 950 may simultaneously deactivate gas exchange valves 321, 721, 891, and 991. In some embodiments, valves 321 and 721 may be intake valves while valves 891 and 991 may be exhaust valves, or vice versa. Various combinations of intake and exhaust valves may be configured with system 900 while pertaining to the scope of the present disclosure. Furthermore, modifications can be made to rolling deactivation system 900 while maintaining the same general function of switching between two variable displacement modes. For example, additional pistons may be fluidly coupled to the accumulator 345 and solenoid valve 365 to increase the number of actuated gas exchange valves. In another example, rather than first through fourth valvetrain systems 390, 790, 890, and 990 being center-pivot valvetrains, the four valvetrain systems may alternatively be end-pivot valvetrains such as the configuration shown in FIG. 6. All four valvetrain systems may have end-pivot configurations or a combination of both end-pivot and center-pivot configurations.

Yet another embodiment of a rolling deactivation system 1000 is shown in FIG. 10. Many devices and/or components in the system of FIG. 10 are the same as devices and/or components shown in FIG. 5. Therefore, for the sake of brevity, devices and components of the system of FIG. 10, and that are included in the system of FIG. 5, are labeled the same and the description of these devices and components is omitted in the description of FIG. 10.

The inventors herein have recognized that on other rolling deactivation systems, if the rocker arm is engaged with a cam lobe upon engine shutdown where rotation is ceased, the hydraulic fluid (often oil) behind the piston of the hydraulic lash adjuster or piston assembly may leak out of the piston housing. An issue may arise during engine startup, wherein several engine cycles may be required to replenish the oil behind the piston. During this time period of engine startup, the cylinder with the gas exchange valve coupled to the hydraulic lash adjuster (or piston assembly) may not operate as desired. As such, the inventors herein have proposed including a latch pin with the aforementioned rolling deactivation systems, such as system 500 of FIG. 5.

FIG. 10 includes most of the components of FIG. 5, with some additions, omissions, and changes. A latch pin 1050 is contained adjacent to piston 371, where the latch pin 1050 may be at least partially embedded in housing 375. As seen in FIG. 10, the side of housing 375 containing latch pin 1050 is larger than housing 375 of FIG. 5. Latch pin 1050 may include a rigid pin attached to a spring such that latch pin 1050 is biased towards a locking position, as later described. Furthermore, a passage 1046 may fluidically couple to both medium pressure chamber 344 and interior 582 of the piston 371. Passage 1046 may connect to an oil gallery of a main fluid pump, where the oil gallery may provide lubricating oil or other hydraulic fluid to a number of engine components. Check valve 341 allows fluid to enter medium pressure chamber 344 while substantially preventing fluid from flowing backwards out of medium pressure chamber 344 into passage 1046. The other components seen in FIG. 10 have been previously described and may operate in similar ways.

Latch pin 1050 may selectively engage a groove in piston 371 at a height that may allow the piston 371 to move a specific amount along the axial direction. By limiting axial movement of piston 371, when the engine is turned off and lobe 353 is engaging rocker arm 360 to push against piston 371, the piston 371 may displace a shorter axial distance than if latch pin 1050 were not included. In this way, oil may be held by piston 371 and not leak out of piston assembly 370.

To selectively engage the groove in piston 371, latch pin 1050 may lock or unlock the piston 371 according to two conditions of the hydraulic rolling deactivation system 1000. Since latch pin 1050 may be located adjacent to piston 371 throughout the axial movement of piston 371, latch pin 1050 may also be located adjacent to piston interior 582, containing hydraulic fluid provided by passage 1046. In particular, the position of latch pin 1050 may be controlled by pressure of hydraulic fluid (oil) provided by a pump that pumps oil through passage 1046. While the engine is operating or running, pressurized oil from passage 1046 may flow to the groove of piston 371, thereby pushing latch pin 1050 towards housing 375 to allow free axial movement of piston 371. Alternatively, while the engine is not running or turned off, the pump providing oil to passage 1046 may also turn off, thereby lowering oil pressure in interior 582. As such, the oil pressure pushing against latch pin 1050 may be lower than the countering spring force on the other side of the pin. Due to the biasing spring force, latch pin 1050 may extend beyond housing 375 and into the groove of piston 371, thereby substantially locking the piston 371 in place so the piston may be unable to move axially.

FIG. 10 shows the position of latch pin 1050 when the engine is running. The presence of oil in passage 1046 and interior 582 is represented by circular dots. Since the engine is running, thereby providing power to the oil pump, oil may be pressurized into passage 1046 and interior 582. Furthermore, pressurized oil inside interior 582 may flow into the groove on piston 371 and push latch pin 1050 away from the groove, overcoming the biasing force of the spring included behind the latch pin 1050. Additionally, oil may be provided from interior 582 to the interface between the pivot pocket 373 and pivot ball. In other embodiments, latch pin 1050 may be oriented at different angles around the periphery of piston 371. For example, the latch pin 1050 may be placed 90 degrees away from passage 1046 rather than 180 degrees as shown in FIG. 10.

FIG. 11 shows the hydraulic rolling deactivation system 1000 of FIG. 10 in a different position than that shown in FIG. 10. In particular, FIG. 11 shows the position of latch pin 1050 when the engine is shut off. As seen, in the case where the engine shuts off and lobe 353 remains engaged with rocker arm 360, rocker arm 360 may provide pushing force to attempt to move piston 371 in the axial direction. Since the engine is turned off, thereby providing no power to the oil pump, oil may be absent from passage 1046 and interior 582 or oil remaining in system 1000 may have a lower pressure than the oil shown in FIG. 10. As oil remaining in interior 582 may have a low pressure or no oil is present, the spring included in latch pin 1050 may force the latch pin into an extended position to engage the groove of piston 371. While in contact with the groove, the latch pin 1050 may substantially prevent positive axial (upward) movement of the piston 371. In this way, piston 371 held in a near-constant axial position may reduce or substantially prevent oil from leaking from piston assembly 370 to rocker arm 360 and/or other components exterior to piston assembly 370. Particularly, the position/size of pin 1050 and the groove may prevent upward movement of piston 371 past a certain point, but may not restrict negative axial (downward) movement within the expected range of motion of the piston 371.

In summary, latch pin 1050 may be deployed to substantially prevent movement of piston 371 during time periods when the engine is not running (turned off) such that the time to recover oil pressure in piston assembly 370 and rest of system 1000 upon engine startup is reduced. By reducing the time to pressurize the oil, the deactivation system 1000 may be commanded (via commanding solenoid valve 365) to deactivate cylinders sooner than if oil were allowed to escape piston assembly 370 without latch pin 1050. Furthermore, during the initial engine cycles after startup, the actual valve lift may more closely match the desired valve lift since the piston 371 remains close to the fully-extended, first position. It is noted that the rolling deactivation system 1000 shown in FIGS. 10 and 11 with latch pin 1050 can be applied to other embodiments that include multiple piston assemblies coupled to a single solenoid valve, as shown in FIGS. 7, 8, and 9.

FIG. 12 shows another example of a rolling cylinder deactivation system 1200 that is similar to system 600 of FIG. 6. Many devices and/or components in the system of FIG. 12 are the same as devices and/or components shown in FIG. 6. Therefore, for the sake of brevity, devices and components of the system of FIG. 12, and that are included in the system of FIG. 6, are labeled the same and the description of these devices and components is omitted in the description of FIG. 12.

Cylinder deactivation system 1200 may be configured to operate with an end-pivot valvetrain similar to system 600 of FIG. 6. Also, system 1200 includes latch pin 1050 as previously described with regard to FIGS. 10 and 11. Latch pin 1050 may be included in a side of housing 375, the housing thicker around the latch pin 1050 than on the other side of piston 371. Similar to the description regarding FIG. 10, latch pin 1050 may be oriented at different angles around the outer circumference or periphery of piston 371 rather than located opposite to the oil passage 675 as shown in FIG. 12. Passage 675 may also be included to provide oil from an oil gallery to chambers 344 and 368 as well as interior 682. The oil of interior 682 may provide the force necessary to force latch pin 1050 away from the groove of piston 371, as previously described. As seen, latch pin 1050 may be included in a variety of rolling cylinder deactivation systems to provide a simple and cost-effective component for reducing oil leakage from piston 371 and associated components. In this way, system 1200 may be utilized to selectively open and close valve 321 in order to deactivate the cylinder with cylinder head 322 that contains valve 321.

FIG. 13 shows a method 1300 for operating a rolling cylinder deactivation system that has the aforementioned latch pin incorporated in the piston housing, such as systems 1000 and 1200. It is noted that throughout method 1300, while several steps may be executed by controller 12 as explained further, most steps may occur as a result of mechanical operation of the latch pin without being directly commanded by controller 12 or other electronic communication. Furthermore, for better understanding of the relation between method 1300 and the aforementioned cylinder deactivation systems, reference to certain components of FIGS. 10 and 11 will be provided when necessary. First, at 1301, one of the two aforementioned valve modes may be initiated, that is, the first mode (standard lift) or the second mode (deactivation). Upon initiation of either of the modes, at 1302 the subsequent steps associated with the selected method may be performed, such as steps 404-409 or 410-415 of FIG. 4. Next, at 1303, if the engine is running then the method may continue at 1304. Alternatively, if the engine has been turned off or shutdown, then the method may continue at 1307.

If the engine is running, then at 1304 pressurized oil may be continuously pumped into oil passage 1046 from the oil gallery connected to or part of passage 1046, where the oil pump may be one of multiple accessories driven by the engine. Subsequently, at 1305, the pressurized oil inside passage 1046 may flow to the groove to push latch pin 1050 away from the piston 371, thereby overcoming the spring force biasing latch pin 1050 towards the piston 371. As such, at 1306, the piston 371 may be allowed to move axially while pressurized oil is located inside interior 582 during engine operation. The free piston movement configuration is shown in FIG. 10.

Alternatively, if the engine has been shut down, then at 1307 oil acting on the face of latch pin 1050 is not pressurized since the pump providing oil to passage 1046 may also be turned off. In this case, the non-pressurization of the oil is relative to the pressurized oil as described in step 1304 when the engine is turned on and the oil pump is operational.

Subsequently, at 1308, the pressure of the remaining oil may be too low to overcome the spring force of the latch pin 1050. As such, at 1309, the spring force of latch pin 1050 may extend the latch pin into the piston groove. The latch pin may move in a direction substantially perpendicular to the axial direction shown in FIGS. 10 and 11. At 1310, since the latch pin 1050 is in the piston groove, the piston 371 may have limited or no axial movement. The substantially locked piston configuration is shown in FIG. 11.

It is noted that modifications may be made to the cylinder deactivation systems of FIGS. 10-12 and associated method of FIG. 13 without departing from the scope of the present disclosure. For example, additional latch pins may be provided to aid in locking piston 371 in place. In another example, rather than being biased towards the piston groove by a spring, latch pin 1050 may be biased by another source such as a hydraulic fluid. As such, other latching configurations and control schemes may be configured while maintaining the same general concept of reducing oil leakage from pump assembly 370 and its associated components. In another embodiment, the latch pin 1050 may include a flat surface to engage with the groove of piston 371 while in a different embodiment the latch pin 1050 may be a round pin. Also, the groove of piston 371 may contain steps to allow piston 371 to be locked at different positions when the pin 1050 extends into the groove from the biasing spring force or other similar force.

In this way, the rolling cylinder deactivation systems described in FIGS. 3-9 may be robust to allow selective deactivation of cylinders and their respective valves with a minimum amount of wearable parts in the load path. In particular, by utilizing hydraulic fluid that may already be present in the engine such as in the oil gallery, the number of moving components may be reduced along with wear on those components. Additionally, the rolling deactivation systems may be applied to other cam actuation systems such as variable valve timing and variable valve lift along with other valve lift control schemes.

Solenoid valve 365 used to fluidically couple or decouple the two chambers 344 and 368 may be a slower-acting solenoid valve with less precise timing compared to other solenoid valves that may be used to control valve lift and duration within a single cam lift event. Since activation or deactivation of solenoid valve 365 may occur during the base circle phase of the camshaft 352, the valve may be less-precisely timed. In this context, the base circle phase may refer to when the lobe 353 is not in contact with the camshaft engaging end of the rocker arm 360. As such, during the time when rocker arm 360 is not actuated by lobe 353, the solenoid valve 365 may activate or deactivate. The required speed of solenoid valve 365 for the present system may be slower compared to similarly-configured solenoid valves in other hydraulic valvetrains that are designed to provide continuously-variable valve lift and duration.

Furthermore, the cost associated with the present hydraulic rolling cylinder deactivation systems may be lower compared to other systems since a single solenoid valve 365 may be configured to open/close one or more of the valves of a single cylinder. Furthermore, if two cylinders were desired to be activated or deactivated in unison, then a single solenoid valve 365 may be used. As such, allowing the use of fewer components for applying cylinder deactivation for multiple cylinders may reduce cost and complexity of the engine system along with freeing packaging space otherwise occupied by additional solenoid valves. Related to the single solenoid valve advantages, system 300 and other systems presented above may operate with one signal from controller 12 per cylinder. In other embodiments, one signal may be used to operate multiple cylinders paired together such that the cylinders deactivate in unison. Other deactivation systems may require multiple signals per cylinder, thereby increasing the complexity of the system and loading the controller with more instructions.

The present rolling cylinder deactivation systems may be compatible with overhead camshaft engines with layouts defined for both center-pivot and end-pivot valvetrain geometries. In this way, rolling deactivation system 300 and others previously presented may be more versatile than other deactivation systems. Additionally, in some embodiments, an engine already fitted with rocker arm 360, valve 321, and camshaft 352 with lobe 353 may be retrofitted with the other components described previously to allow for cylinder deactivation.

Lastly, the addition of latch pin 1050 to the rolling cylinder deactivation systems as presented in FIGS. 10-13 may allow for proper cylinder and gas exchange valve operation upon engine startup. By limiting the amount of oil leakage from the piston assembly 370, the gas exchange valve 321 may be operated according to the first and second valve lift modes soon after engine startup. Latch pin 1050 may be deployed to substantially lock the piston 371 in place during the time that the engine is not running so that the time to recover oil pressure behind the piston is reduced.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A poppet valve operator, comprising:

a rocker arm including a poppet valve engaging end and a camshaft engaging end, the rocker arm including a pivot pocket positioned between the camshaft engaging end and the poppet valve engaging end;

a hydraulically operated pivot ball attached to a piston contained within a piston housing, the pivot ball selectively engaging the pivot pocket based on a position of a solenoid valve;

a high pressure chamber in fluidic communication with an outlet of the piston housing, the high pressure chamber further in fluidic communication with an oil gallery of an engine oil pump via a first hydraulic passage; and a medium pressure chamber in fluidic communication with the oil gallery via a second hydraulic passage, wherein the high pressure chamber and the medium pressure chamber are fluidically connected when the solenoid valve is in an open position, creating a single continuous pressure chamber, and wherein the high pressure chamber is fluidically separated from the medium pressure chamber when the solenoid valve is in a closed position.

2. The poppet valve operator of claim 1, wherein the solenoid valve is positioned along the continuous pressure chamber, the continuous pressure chamber extending from the hydraulically operated pivot ball to an accumulator.

3. The poppet valve operator of claim 1, wherein the medium pressure chamber is supplied with hydraulic fluid from the oil gallery by the second hydraulic passage without allowing fluid backflow into the second hydraulic passage via a check valve located in the second hydraulic passage, and wherein the high pressure chamber is supplied with hydraulic fluid from the oil gallery by the first hydraulic passage without allowing fluid backflow into the first hydraulic passage via a check valve located in the first hydraulic passage.

4. The poppet valve operator of claim 1, wherein the pivot ball and piston are restricted to move only axially.

5. The poppet valve operator of claim 4, wherein the pivot ball is located on a piston stem of the piston.

6. The poppet valve operator of claim 5, further comprising a latch pin configured to selectively engage the piston.

7. The poppet valve operator of claim 1, wherein oil is replenished by the oil pump via the first and second hydraulic passages when a camshaft is in a base circle phase where a cam lobe is not in contact with the rocker arm.

8. A poppet valve operator, comprising:

a rocker arm including a poppet valve engaging end and a camshaft engaging end, the rocker arm including a pivot pocket positioned between the camshaft engaging end and the poppet valve engaging end;

a hydraulically operated pivot ball selectively engaging the pivot pocket when a solenoid valve is in an open position, the solenoid valve fluidically connecting a medium pressure chamber and a high pressure chamber to create a single continuous pressure chamber extending from the hydraulically operated pivot ball to an accumulator when in the open position, and fluidically separating the medium pressure chamber and high pressure chamber when in a closed position; and a latch pin selectively engaging a hydraulically operated pivot ball actuator configured to move the pivot ball.

9. The poppet valve operator of claim 8, wherein the medium and high pressure chambers are supplied with hydraulic fluid by one or more hydraulic passages without allowing fluid backflow into the one or more hydraulic passages via one or more check valves located in the one or more hydraulic passages.

10. The poppet valve operator of claim 8, wherein the hydraulically operated pivot ball actuator is a piston wholly contained within a piston housing, and wherein the high pressure chamber fluidically communicates with an outlet of the piston housing when the solenoid valve is in the open position and the closed position.

11. The poppet valve operator of claim 10, wherein the pivot ball and piston are restricted to move only axially.

12. A method for cylinder deactivation, comprising:

during a first mode, closing a solenoid valve to trap hydraulic fluid located behind a piston of a hydraulically operated pivot ball, the hydraulic fluid holding the pivot ball in place and allowing a rocker arm to pivot about the pivot ball to actuate a poppet valve via rotation of a cam lobe while fluidically separating a high pressure chamber from a medium pressure chamber, the high pressure chamber coupled to an outlet of a housing of the piston and the medium pressure chamber coupled to an accumulator; and during a second mode, opening the solenoid valve to fluidically connect the high pressure chamber and medium pressure chamber, thereby creating a single continuous pressure chamber, and to allow hydraulic fluid located behind the piston of the pivot ball to enter the accumulator via the continuous pressure chamber, the hydraulic fluid allowing the pivot ball to move and preventing the rocker arm from actuating the poppet valve.

13. The method of claim 12, wherein the rocker arm includes a poppet valve engaging end and a camshaft engaging end, the pivot ball in contact with the rocker arm between the camshaft engaging end and the poppet valve engaging end.

14. The method of claim 12, wherein the rocker arm includes a poppet valve engaging end and a pivot ball engaging end, the cam lobe in contact with the rocker arm between the pivot ball engaging end and the poppet valve engaging end.

15. The method of claim 12, wherein the first and second modes are selected by opening or closing the solenoid valve.

16. The method of claim 12, wherein the piston further includes a latch pin configured to selectively engage the piston.

17. The method of claim 12, wherein the solenoid valve and accumulator are fluidly coupled to additional pistons that are in contact with additional rocker arms and gas exchange valves.

18. The method of claim 12, further comprising, during the second mode, after continuing to rotate a camshaft on which the cam lobe is arranged until the cam lobe is no longer in contact with the rocker arm, pushing hydraulic fluid back from the accumulator through the continuous pressure chamber and then behind the piston.

19. The method of claim 12, wherein during the second mode, the piston remains in contact with the rocker arm, and is flexibly engaged with the rocker arm.

* * * * *